US006378473B2

(12) United States Patent
Yamaki et al.

(10) Patent No.: US 6,378,473 B2
(45) Date of Patent: Apr. 30, 2002

(54) METHOD OF CONTROLLING ELECTROMAGNETIC VALVE UNIT FOR INTERNAL COMBUSTION ENGINES

(75) Inventors: Toshihiro Yamaki; Minoru Nakamura; Jiro Fujimoto, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/740,348

(22) Filed: Dec. 18, 2000

(30) Foreign Application Priority Data

Dec. 17, 1999 (JP) ..... 11-359979

(51) Int. Cl.[7] ..... F01L 9/04

(52) U.S. Cl. ..... 123/90.11; 251/129.15; 251/129.18

(58) Field of Search ..... 123/90.11, 90.12, 123/90.15; 251/129.15, 129.16, 129.18

(56) References Cited

U.S. PATENT DOCUMENTS 6,176,209 B1 * 1/2001 Ishii ..... 123/90.11

* cited by examiner

*Primary Examiner*—Thomas Denion
*Assistant Examiner*—Jaime Corrigan
(74) *Attorney, Agent, or Firm*—Lahive & Cockfield, LLP

(57) ABSTRACT

An electromagnetic valve unit in an internal combustion engine is controlled by determining a difference between the output of a displacement sensor when a valve head is in an open position and the output of the displacement sensor when the valve head is in a closed position in each period of an opening and closing action of the valve head. The difference corresponds to a full displacement of the valve head between the open position and the closed position. The electromagnetic valve unit is also controlled by establishing, using the difference, a threshold for the output of the displacement sensor which corresponds to a predetermined displaced position of the valve head which is determined based on a proportion of the full displacement, and controlling energization of the valve-opening electromagnet and/or the valve-closing electromagnet depending on whether the output of the displacement sensor has reached the threshold or not upon the opening and closing action of the valve head immediately after the threshold is established.

19 Claims, 12 Drawing Sheets

1ST AND 3RD FAILURE PROCESSES

2ND FAILURE PROCESS

4TH FAILURE PROCESS

METHOD OF CONTROLLING ELECTROMAGNETIC VALVE UNIT FOR INTERNAL COMBUSTION ENGINES

BACKGROUND OF THE INVENTION

1. Field of the Invention

The present invention relates to a method of controlling an electromagnetic valve unit for use in internal combustion engines.

2. Description of the Related Art

Heretofore, there have been known electromagnetic valve units for selectively opening and closing intake or exhaust valves in the cylinders of internal combustion engines. A basic structure of such an electromagnetic valve unit is shown in FIG. 1 of the accompanying drawings.

As shown in FIG. 1, the electromagnetic valve unit has a valve head 3 for selectively opening and closing an intake or exhaust port 2 (hereinafter referred to as "intake/exhaust port 2") of a combustion chamber 1 of each cylinder of an internal combustion engine. The valve head 3 is mounted on an end of a shank 3*a*, and an armature 4 in the form of an iron disk is attached to the other end of the shank 3*a*. The shank 3*a* is axially reciprocally, i.e., vertically in FIG. 1, movable to move the valve head 3 between a closed position, indicated by the imaginary lines, for closing the intake/exhaust port 2 and an open position, indicated by the imaginary lines, for opening the intake/exhaust port 2.

Some electromagnetic valve units include a drive rod (not shown) held coaxially against the upper end of a valve stem for movement in union with the valve stem, and an armature attached to the drive rod. In such electromagnetic valve units, the valve stem and the drive rod jointly correspond to the shank 3*a* shown in FIG. 1.

The electromagnetic valve unit shown in FIG. 1 has electromagnets 5, 6 positioned respectively above and below the armature 4 and having respective solenoids 5*a*, 6*a*. The electromagnet 5 serves as a valve-closing electromagnet which, when the solenoid 5*a* is energized, generates electromagnetic forces to lift and attract the armature 4 thereby to move the valve head 3 into the closed position. The electromagnet 6 serves as a valve-opening electromagnet which, when the solenoid 6*a* is energized, generates electromagnetic forces to lower and attract the armature 4 thereby to move the valve head 3 into the open position.

The electromagnetic valve unit also has a spring 7 positioned above the armature 4 for normally urging the armature 4 to lower the valve head 3 toward the open position, and a spring 8 positioned below the armature 4 for normally urging the armature 4 to lift the valve head 3 toward the closed position. When the electromagnets 5, 6 are de-energized, the biasing forces of the springs 7, 8 are kept in equilibrium to hold the valve head 3 in a neutral position, indicated by the solid lines, between the closed and open positions. Therefore, the springs 7, 8 jointly serve as a biasing means for biasing the valve head 3 in the neutral position.

For opening the valve head 3 from the closed position in which the armature 4 is attracted to the valve-closing electromagnet 5 under its electromagnetic forces, the solenoid 5*a* of the valve-closing electromagnet 5 is de-energized to release the armature 4 from the valve-closing electromagnet 5, allowing the valve head 3 to move from the closed position toward the open position under the combined biasing forces of the springs 7, 8. On the movement of the valve head 3 from the closed position toward the open position, the solenoid 6*a* of the valve-opening electromagnet 6 are energized to attract the armature 4 until the valve head 3 reaches the open position, whereupon the valve head 3 is maintained in the open position.

For moving the valve head 3 from the open position toward the closed position, the solenoid 6*a* is de-energized to release the armature 4 from the valve-opening electromagnet 6. Thereafter, the solenoid 5*a* is energized to attract the armature 4 against the valve-closing electromagnet 5. In this manner, the valve head 3 is displaced from the open position into the closed position, and held in the closed position.

The above cycle of opening and closing the valve head 3 is periodically performed in synchronism with the rotational speed of the internal combustion engine.

In order to introduce intake air into and discharge exhaust gases from the combustion chamber 1 smoothly for efficiently operating the internal combustion engine, it is necessary to open and close the valve head 3 such that the displaced position of the valve head 3 between the closed and open positions changes in a desired time-dependent pattern according to the rotational speed of the internal combustion engine. If the opening and closing action of the valve head 3 suffers a difficulty for some reason, such a faulty situation needs to be recognized properly and the valve head 3 needs to be operated for the purpose of avoiding the trouble.

It has been customary for the electromagnetic valve unit to incorporate a displacement sensor for detecting the displaced position of the valve head 3, and to control the energization of the valve-closing electromagnet 5 and the valve-opening electromagnet 6 depending on the displaced position of the valve head 3 as detected by the displacement sensor. The displaced position of the valve head 3 is recognized by comparing the output from the displacement sensor with a predetermined threshold.

Output characteristics of the displacement sensor with respect to the displaced position of the valve head 3 tend to vary from displacement sensor to displacement sensor and also tend to change due to aging. For these reasons, when the output from the displacement sensor is compared with a fixed threshold, the displaced position of the valve head 3 as recognized based on the comparison is liable to vary. As a result, it is difficult to control the energization of the valve-closing electromagnet 5 and the valve-opening electromagnet 6 in order to open and close the valve head 3 accurately and reliably irrespectively of individual internal combustion engines or the period in which the individual internal combustion engine has been used. It is also difficult to appropriately recognize a failure of the opening and closing action of the valve head 3 and adequately operate the valve head 3 depending on the recognized opening and closing action thereof.

Even if the output of the displacement sensor is highly accurate, the opening and closing action of the valve head 3 is affected by the friction of various related parts, the combustion pressure in the combustion chamber 1, different characteristics of the springs 7, 8, and their time-dependent changes. Consequently, if the energization of the valve-closing electromagnet 5 and the valve-opening electromagnet 6 is controlled in a fixed pattern depending on the output of the displacement sensor, then it is difficult to control the opening and closing action of the valve head 3 accurately and stably.

SUMMARY OF THE INVENTION

It is therefore an object of the present invention to provide a method of controlling an electromagnetic valve unit for use in internal combustion engines by appropriately performing a process of controlling the energization of a valve-closing electromagnet or a valve-opening electromagnet to open and close a valve head while compensating for variations of the output of a displacement sensor and variations of the friction of various related parts, for thereby opening and closing the valve head accurately and stably.

According to an aspect of the present invention, there is provided a method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing the valve head to a neutral position between the open position and the closed position, a valve-opening electromagnet for displacing the valve head into the open position under electromagnetic forces, a valve-closing electromagnet for displacing the valve head into the closed position under electromagnetic forces, and a displacement sensor for generating an output depending on a displaced position of the valve head, the method comprising the steps of determining a difference between the output of the displacement sensor when the valve head is in the open position and the output of the displacement sensor when the valve head is in the closed position in each period of an opening and closing action of the valve head, the difference corresponding to a full displacement of the valve head between the open position and the closed position, and establishing, using the difference, a threshold for the output of the displacement sensor which corresponds to a predetermined displaced position of the valve head which is determined based on a proportion of the full displacement, and controlling energization of the valve-opening electromagnet and/or the valve-closing electromagnet depending on whether the output of the displacement sensor has reached the threshold or not upon the opening and closing action of the valve head immediately after the threshold is established.

In the above method, the difference between the output of the displacement sensor when the valve head is in the open position and the output of the displacement sensor when the valve head is in the closed position is determined in each period of an opening and closing action of the valve head. The predetermined displaced position of the valve head for performing energization of the valve-opening electromagnet and the valve-closing electromagnet is determined based on a proportion of the full displacement, and a threshold for the output of the displacement sensor which corresponds to the displaced position is determined using the difference between the outputs of the displacement sensor.

Since the full displacement of the valve head between the open and closed positions corresponds to the difference between the outputs of the displacement sensor, the threshold for the output of the displacement sensor which corresponds to the displaced position determined by the proportion of the full displacement is determined by the proportion according to a proportional distribution. If the displaced position of the valve head is determined as a position displaced from the closed or open position by X % of the full displacement, then the threshold for the output of the displacement sensor is determined as a value which is changed, by X % of the difference, from the output of the displacement sensor when the valve head is in the closed position or the output of the displacement sensor when the valve head is in the open position.

The threshold thus established for the output of the displacement sensor depends on the output characteristics of individual displacement sensors and the output characteristics of the displacement sensor as they vary from time to time. Therefore, the threshold for the output of the displacement sensor which corresponds to the displaced position of the valve head can appropriately be established irrespectively of variations in the output characteristics of the displacement sensor and time-dependent changes therein.

In the above method, energization of the valve-opening electromagnet and/or the valve-closing electromagnet is controlled depending on whether the output of the displacement sensor has reached the threshold or not upon the opening and closing action of the valve head immediately after the threshold is established. Inasmuch as the threshold corresponds to the displaced position of the valve head, energization of the valve-opening electromagnet and/or the valve-closing electromagnet can be controlled at a desired displaced position of the valve head. As a result, the valve head can appropriately be opened and closed as desired.

Therefore, energization of the valve-opening electromagnet and/or the valve-closing electromagnet can be controlled while compensating for variations in the output of the displacement sensor, and hence the valve head can accurately be opened and closed.

The difference between the outputs of the displacement sensor can be determined using only the outputs of the displacement sensor in one period of the opening and closing action of the valve head for establishing the threshold. Preferably, however, the difference comprises a difference between an average value of outputs of the displacement sensor when the valve head is in the open position over a plurality of periods of the opening and closing action of the valve head and an average value of outputs of the displacement sensor when the valve head is in the closed position over a plurality of periods of the opening and closing action of the valve head.

In this manner, the effect of a noise component which may temporarily be contained in the output of the displacement sensor can be compensated for, and hence the difference is made highly reliable. The threshold for the output of the displacement sensor which corresponds to the displaced position of the valve head is also made reliable.

The threshold may include a first threshold corresponding to a position of the valve head which is displaced from one of the open position and the closed position by a first proportion of the full displacement, and the step of controlling energization of the valve-opening electromagnet and/or the valve-closing electromagnet may comprise the steps of measuring a time after the valve-closing electromagnet is de-energized until the output of the displacement sensor reaches the first threshold when the valve head is opened from the closed position, and adjusting a timing to de-energize the valve-closing electromagnet when the valve head is to be opened next time, depending on the measured time.

The threshold may also include a second threshold corresponding to a position of the valve head which is displaced from one of the open position and the closed position by a second proportion of the full displacement, and the step of controlling energization of the valve-opening electromagnet and/or the valve-closing electromagnet may comprise the steps of measuring a time after the valve-opening electromagnet is de-energized until the output of the displacement sensor reaches the second threshold when the valve head is closed from the open position, and adjusting a timing to de-energize the valve-opening electromagnet when the valve head is to be closed next time, depending on the measured time.

The valve head starts being opened from the closed position or closed from the open position when the valve-closing electromagnet and the valve-opening electromagnet are de-energized. To cause the timings to open and close the valve head to match the operating state of the internal combustion engine, it is important to determine a time for the valve head to move to a certain displaced position after the valve-closing electromagnet or the valve-opening electromagnet is de-energized. Such a time, however, tends to vary because of various factors including the friction of various related parts, the characteristics of the biasing means, the internal pressure (combustion pressure) in the combustion chamber, and remaining magnetic forces immediately after the electromagnets are de-energized.

According to the invention, for opening the valve head, a time after the valve-closing electromagnet is de-energized until the output of the displacement sensor reaches the first threshold is measured when the valve head is opened from the closed position, and a timing to de-energize the valve-closing electromagnet when the valve head is to be opened next time is adjusted depending on the measured time. For closing the valve head, a time after the valve-opening electromagnet is de-energized until the output of the displacement sensor reaches the second threshold is measured when the valve head is closed from the open position, and a timing to de-energize the valve-opening electromagnet when the valve head is to be closed next time is adjusted depending on the measured time.

It is thus possible to adjust the above time to a desired time while compensating for the friction of various related parts, variations in the characteristics of the biasing means, etc. Since the first or second threshold is established as described above, the measured time accurately agrees with the time required after the valve-closing electromagnet or the valve-opening electromagnet is de-energized until the valve head actually moves to the displaced position. Consequently, when the timing to de-energize the valve-closing electromagnet and the valve-opening electromagnet is adjusted depending on the measured time, it is possible to control the timing for the valve head to the displaced position reliably at a desired timing.

The threshold may include a third threshold corresponding to a position of the valve head which is displaced from one of the open position and the closed position by a third proportion of the full displacement, and a fourth threshold corresponding to a position of the valve head which is closer to the open position than the position corresponding to said third position and displaced from one of the open position and the closed position by a fourth proportion of the full displacement, and the step of controlling energization of the valve-opening electromagnet and/or the valve-closing electromagnet may comprise the steps of measuring a time after the output of the displacement sensor reaches the third threshold until the output of the displacement sensor reaches the fourth threshold when the valve head is opened from the closed position, and adjusting a timing to energize the valve-opening electromagnet when the valve head is to be opened next time, depending on the measured time.

Furthermore, the threshold may include a fifth threshold corresponding to a position of the valve head which is displaced from one of the open position and the closed position by a fifth proportion of the full displacement, and a sixth threshold corresponding to a position of the valve head which is closer to the closed position than the position corresponding to the fifth proportion and displaced from one of the open position and the closed position by a sixth proportion of the full displacement, and the step of controlling energization of the valve-opening electromagnet and/or the valve-closing electromagnet may comprise the steps of measuring a time after the output of the displacement sensor reaches the fifth threshold until the output of the displacement sensor reaches the sixth threshold when the valve head is closed from the open position, and adjusting a timing to energize the valve-opening electromagnet when the valve head is to be closed next time, depending on the measured time.

To cause the opening and closing action of the valve head to match the operating state of the internal combustion engine, it is important to determine a speed at which the valve head moves from the closed position to the open position and a speed at which the valve head moves from the open position to the closed position. However, those speeds are liable to vary because of various factors including the friction of various related parts, the characteristics of the biasing means, the internal pressure (combustion pressure) in the combustion chamber, and remaining magnetic forces immediately after the electromagnets are de-energized. For opening the valve head, the above speed can be controlled by the timing to energize the valve-opening electromagnet, and for closing the valve head, the above speed can be controlled by the timing to energize the valve-closing electromagnet.

According to the present invention, as described above, for opening the valve head, a time after the output of the displacement sensor reaches the third threshold until the output of the displacement sensor reaches the fourth threshold is measured when the valve head is opened from the closed position, and a timing to energize the valve-opening electromagnet when the valve head is to be opened next time is adjusted depending on the measured time. For closing the valve head, a time after the output of the displacement sensor reaches the fifth threshold until the output of the displacement sensor reaches the sixth threshold is measured when the valve head is closed from the open position, and a timing to energize the valve-opening electromagnet when the valve head is to be closed next time is adjusted depending on the measured time. Since the third through sixth thresholds are established as described above, the output of the displacement sensor in the displaced position of the valve head is highly reliable. The measured times are also highly reliable as representing the actual speed of the valve head.

Therefore, the speed of the valve head as it is opened or closed can be controlled accurately at a desired speed while compensating for the friction of various related parts, etc.

The threshold may include a seventh threshold corresponding to a position of the valve head which is close to the open position and displaced from one of the open position and the closed position by a seventh proportion of the full displacement, and the step of controlling energization of the valve-opening electromagnet and/or the valve-closing electromagnet may comprise the steps of energizing the valve-opening electromagnet in a constant-voltage control mode after the valve-opening electromagnet starts being energized until the output of the displacement sensor reaches the seventh threshold when the valve head is opened from the closed position, and energizing the valve-opening electromagnet in a constant-current control mode after the output of the displacement sensor reaches the seventh threshold.

The threshold may include an eighth threshold corresponding to a position of the valve head which is close to the closed position and displaced from one of the open position and the closed position by an eighth proportion of the full displacement, and the step of controlling energization of the valve-opening electromagnet and/or the valve-closing electromagnet may comprise the steps of energizing the valve-closing electromagnet in a constant-voltage control mode after the valve-closing electromagnet starts being energized until the output of the displacement sensor reaches the eighth threshold when the valve head is closed from the open position, and energizing the valve-closing electromagnet in a constant-current control mode after the output of the displacement sensor reaches the eighth threshold.

For opening the valve head, until the valve head reaches a position close to the open position, the valve-opening electromagnet is preferably energized in the constant-voltage control mode in which a solenoid of the valve-opening electromagnet is energized under a constant voltage applied thereto. Similarly, the valve-closing electromagnet is preferably energized in the constant-voltage control mode in which a solenoid of the valve-closing electromagnet is energized under a constant voltage applied thereto. The constant-voltage control mode allows the valve head to move quickly to the open or closed position because the current supplied to the electromagnet increases, i.e., electromagnetic forces generated thereby increase, ass the valve head moves. When the valve head moves to a position near the open position at the time it is to be opened or when the valve head moves to a position near the closed position at the time it is to be closed, the valve-opening electromagnet or the valve-closing electromagnet is preferably energized in the constant-current control mode in which the solenoid of the electromagnet is energized with a constant current supplied thereto. Particularly after the valve head has reached the open or closed position, the valve head is preferably held in that position in the constant-current control mode because electromagnetic forces required to hold the valve head in the position may be relatively small.

According to the present invention, as described above, for opening the valve head, the valve-opening electromagnet is energized in the constant-voltage control mode after the valve-opening electromagnet starts being energized until the output of the displacement sensor reaches the seventh threshold corresponding to the position in the vicinity of the open position, and the valve-opening electromagnet is energized in the constant-current control mode after the output of the displacement sensor reaches the seventh threshold. For closing the valve head, the valve-closing electromagnet is energized in the constant-voltage control mode after the valve-closing electromagnet starts being energized until the output of the displacement sensor reaches the eighth threshold corresponding to the position in the vicinity of the closed position, and the valve-closing electromagnet is energized in the constant-current control mode after the output of the displacement sensor reaches the eighth threshold.

When the valve head is opened, the valve head can smoothly be moved to the open position, smoothly reach the open position, and smoothly be held in the open position. Similarly, when the valve head is closed, the valve head can smoothly be moved to the closed position, smoothly reach the closed position, and smoothly be held in the closed position. Inasmuch as the seventh or eighth threshold for determining the timing to change from the constant-voltage control mode to the constant-current control mode is determined as described above, the energization of the electromagnets can be switched between these control modes at a desired displaced position of the valve head near the open or closed position without being affected by variations in the output characteristics of the displacement sensor, etc. Thus, the valve head can stably and smoothly be opened and closed regardless of variations in the output characteristics of the displacement sensor, etc. Because the timing to change from the constant-voltage control mode to the constant-current control mode determined by the seventh or eighth threshold is highly reliable, the electric energy supplied to the electromagnets is minimized, and hence the power consumption by the electromagnets is reduced.

The threshold may include a ninth threshold corresponding to a position of the valve head which is close to the open position and displaced from one of the open position and the closed position by a ninth proportion of the full displacement, and the step of controlling energization of the valve-opening electromagnet and/or the valve-closing electromagnet may comprise the step of performing a first failure process to control energization of the valve-opening electromagnet and/or the valve-closing electromagnet if the output of the displacement sensor has not reached the ninth threshold at a predetermined timing when the valve head is opened from the closed position.

The threshold may include a tenth threshold corresponding to a position of the valve head which is close to the closed position and displaced from one of the open position and the closed position by a tenth proportion of the full displacement, and the step of controlling energization of the valve-opening electromagnet and/or the valve-closing electromagnet comprises the step of performing a second failure process to control energization of the valve-opening electromagnet and/or the valve-closing electromagnet if the output of the displacement sensor has not reached the tenth threshold at a predetermined timing when the valve head is closed from the open position.

When the valve head is to be opened, if the valve head moves normally from the closed position to the open position, then the valve head reaches a certain displaced position or a position closer to the open position than the displaced position at a certain timing, e.g., when a certain time has elapsed after the valve-closing electromagnet is de-energized. Similarly, when the valve head is to be closed, if the valve head moves normally from the open position to the closed position, then the valve head reaches a certain displaced position or a position closer to the closed position than the displaced position at a certain timing, e.g., when a certain time has elapsed after the valve-opening electromagnet is de-energized. If the valve head has not reached such a position at the above timing, then the valve head is suffering a certain malfunction.

According to the present invention, as described above, the first failure process is performed to control energization of the valve-opening electromagnet and/or the valve-closing electromagnet if the output of the displacement sensor has not reached the ninth threshold at a predetermined timing when the valve head is opened from the closed position. Likewise, the second failure process is performed to control energization of the valve-opening electromagnet and/or the valve-closing electromagnet if the output of the displacement sensor has not reached the tenth threshold at a predetermined timing when the valve head is closed from the closed position.

Therefore, when the valve head malfunctions as it moves at the time it is opened or closed, it is possible to energize the valve-opening electromagnet or the valve-closing electromagnet in a manner to cope with the malfunction. Since the ninth or tenth threshold is established as described above, it reliably corresponds to the desired displaced position of the valve head in the vicinity of the open or closed position irrespectively of variations in the output characteristics of the displacement sensor, etc. Consequently, only when the valve head malfunctions upon its movement at the time it is opened or closed, the first or second failure process can be carried out to energize the valve-opening electromagnet or the valve-closing electromagnet in a manner to cope with the malfunction.

The first or second failure process may comprise a process of alternately energizing the valve-opening electromagnet and the valve-closing electromagnet in predetermined periods until the valve head reaches either one of the valve-opening electromagnet and the valve-closing electromagnet.

By thus alternately energizing the valve-opening electromagnet and the valve-closing electromagnet in predetermined periods, the valve head is vibrated between the open and closed positions, and can be moved to one of the open and closed positions due to reduced resonance. When the valve head is moved to one of the open and closed positions, the valve head can then resume its normal opening and closing action from that position.

The threshold may include an eleventh threshold corresponding to a position of the valve head which is close to the open position and displaced from one of the open position and the closed position by an eleventh proportion of the full displacement, and the step of controlling energization of the valve-opening electromagnet and/or the valve-closing electromagnet may comprise the step of performing a third failure process to control energization of the valve-opening electromagnet and/or the valve-closing electromagnet when the output of the displacement sensor has changed to the eleventh threshold before the valve-opening electromagnet is de-energized, after the valve head is displaced from the closed position to the open position.

The threshold may include a twelfth threshold corresponding to a position of the valve head which is close to the closed position and displaced from one of the open position and the closed position by a twelfth proportion of the full displacement, and the step of controlling energization of the valve-opening electromagnet and/or the valve-closing electromagnet may comprise the step of performing a fourth failure process to control energization of the valve-opening electromagnet and/or the valve-closing electromagnet when the output of the displacement sensor has changed to the twelfth threshold before the valve-closing electromagnet is de-energized, after the valve head is displaced from the open position to the closed position.

After the valve head has reached the open position, if the valve head is displaced toward the closed position to a position in the vicinity of the open position, then the valve head suffers a certain malfunction. similarly, after the valve head has reached the closed position, if the valve head is displaced toward the open position to a position in the vicinity of the closed position, then the valve head suffers a certain malfunction.

According to the present invention, as described above, after the valve head is displaced from the closed position to the open position, the third failure process is performed to control energization of the valve-opening electromagnet and/or the valve-closing electromagnet when the output of the displacement sensor has changed to the eleventh threshold before the valve-opening electromagnet is de-energized. Likewise, after the valve head is displaced from the open position to the closed position, the fourth failure process is performed to control energization of the valve-opening electromagnet and/or the valve-closing electromagnet when the output of the displacement sensor has changed to the twelfth threshold before the valve-closing electromagnet is de-energized.

In this manner, when the valve head cannot be held in the open or closed position due to a malfunction, it is possible to energize the valve-opening electromagnet or the valve-closing electromagnet in a manner to cope with the malfunction. Inasmuch as the eleventh and twelfth thresholds are established as described above, they reliably correspond to the desired displaced position of the valve head for determining whether the third and fourth failure processes are to be performed or not, irrespectively of variations in the output characteristics of the displacement sensor, etc. Consequently, only when the valve head malfunctions and fails to be held in the open or closed position, the third or fourth failure process can be carried out to energize the valve-opening electromagnet or the valve-closing electromagnet in a manner to cope with the malfunction.

The third failure process may comprise a process of deciding whether the valve head can be returned to the open position by energizing the valve-opening electromagnet within a period up to a timing to de-energize the valve-opening electromagnet in order to close the valve head, energizing the valve-opening electromagnet to return the valve head to the open position if the valve head can be returned to the open position within the period, de-energizing the valve-opening electromagnet if the valve head cannot be returned to the open position within the period, and energizing the valve-closing electromagnet to move the valve head to the closed position at a predetermined timing.

The fourth failure process may comprise a process of deciding whether the valve head can be returned to the closed position by energizing the valve-closing electromagnet within a period up to a timing to de-energize the valve-closing electromagnet in order to open the valve head, energizing the valve-closing electromagnet to return the valve head to the closed position if the valve head can be returned to the closed position within the period, de-energizing the valve-closing electromagnet if the valve head cannot be returned to the closed position within the period, and energizing the valve-opening electromagnet to move the valve head to the open position at a predetermined timing.

By thus controlling energization of the valve-opening electromagnet and the valve-closing electromagnet, the normal opening and closing action of the valve head can be recovered without impairing the operating state of the internal combustion engine.

The first through twelfth thresholds described above may be different from each other, or some of the first through twelfth thresholds may be identical to each other.

According to another aspect of the present invention, there is provided a method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing the valve head to a neutral position between the open position and the closed position, a valve-opening electromagnet for displacing the valve head into the open position under electromagnetic forces, a valve-closing electromagnet for displacing the valve head into the closed position under electromagnetic forces, and a displacement sensor for generating an output depending on a displaced position of the valve head, the method comprising the steps of determining a first threshold for the output of the displacement sensor which corresponds to a position of the valve head which is displaced from one of the open position and the closed position by a first distance and a second threshold for the output of the displacement sensor which is closer to the open position than the position corresponding to the first distance and displaced from one of the open position and the closed position by a second distance, measuring a time after the output of the displacement sensor has reached the first threshold until the output of the displacement sensor reaches the second threshold when the valve head is opened from the closed position, and adjusting a timing to energize the valve-opening electromagnet when the valve head is to be opened next time, depending on the measured time.

According to still another aspect of the present invention, there is provided a method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing the valve head to a neutral position between the open position and the closed position, a valve-opening electromagnet for displacing the valve head into the open position under electromagnetic forces, a valve-closing electromagnet for displacing the valve head into the closed position under electromagnetic forces, and a displacement sensor for generating an output depending on a displaced position of the valve head, the method comprising the steps of determining a third threshold for the output of the displacement sensor which corresponds to a position of the valve head which is displaced from one of the open position and the closed position by a third distance and a fourth threshold for the output of the displacement sensor which is closer to the closed position than the position corresponding to the third distance and displaced from one of the open position and the closed position by a fourth distance, measuring a time after the output of the displacement sensor has reached the third threshold until the output of the displacement sensor reaches the fourth threshold when the valve head is closed from the open position, and adjusting a timing to energize the valve-closing electromagnet when the valve head is to be closed next time, depending on the measured time.

In the above two latter methods, two thresholds, i.e., the first and second threshold or the third and fourth thresholds, for the output of the displacement sensor are determined as corresponding to two displaced positions between the open and closed positions. When the valve head is to be opened or closed, a time required after the output of the displacement sensor has reached one of the thresholds until the output of the displacement sensor reaches the other threshold is measured. The measured time corresponds to a speed of the valve head as it is opened or closed. The timing to energize the valve-opening electromagnet to open the valve head next time or the timing to energize the valve-closing electromagnet to close the valve head next time is adjusted depending on the measured time.

As a consequence, the speed at which the valve head moves when it is opened or closed can be controlled accurately at a desired speed while compensating for the friction of various related parts, the characteristics of the biasing means, the internal pressure (combustion pressure) in the combustion chamber, and remaining magnetic forces immediately after the electromagnets are de-energized.

The above two latter methods can be carried out simultaneously in combination with each other.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
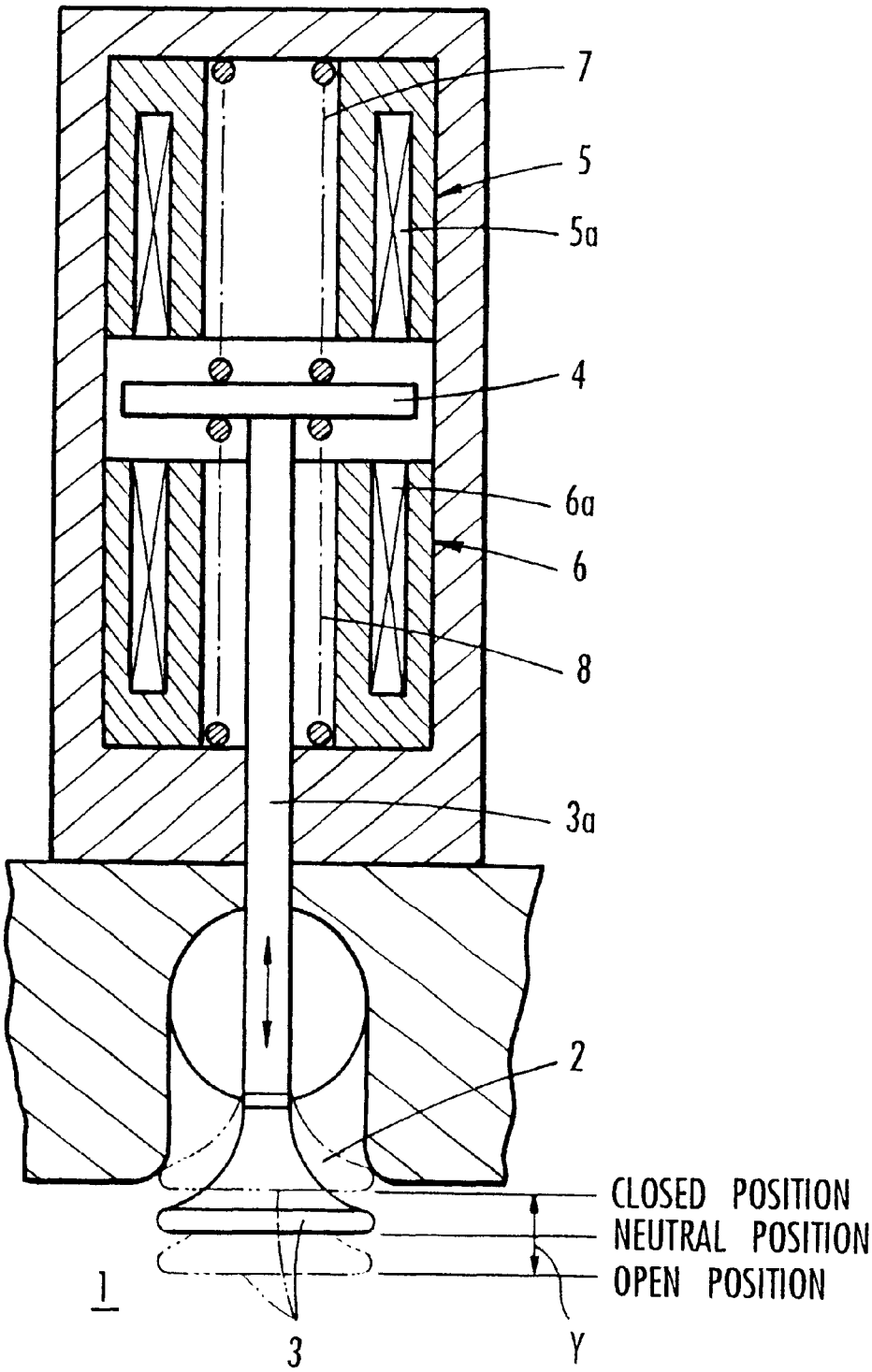
FIG. 1 is a vertical cross-sectional view showing a basic structure of an electromagnetic valve unit to be controlled by a method according to the present invention.
Figure 2:
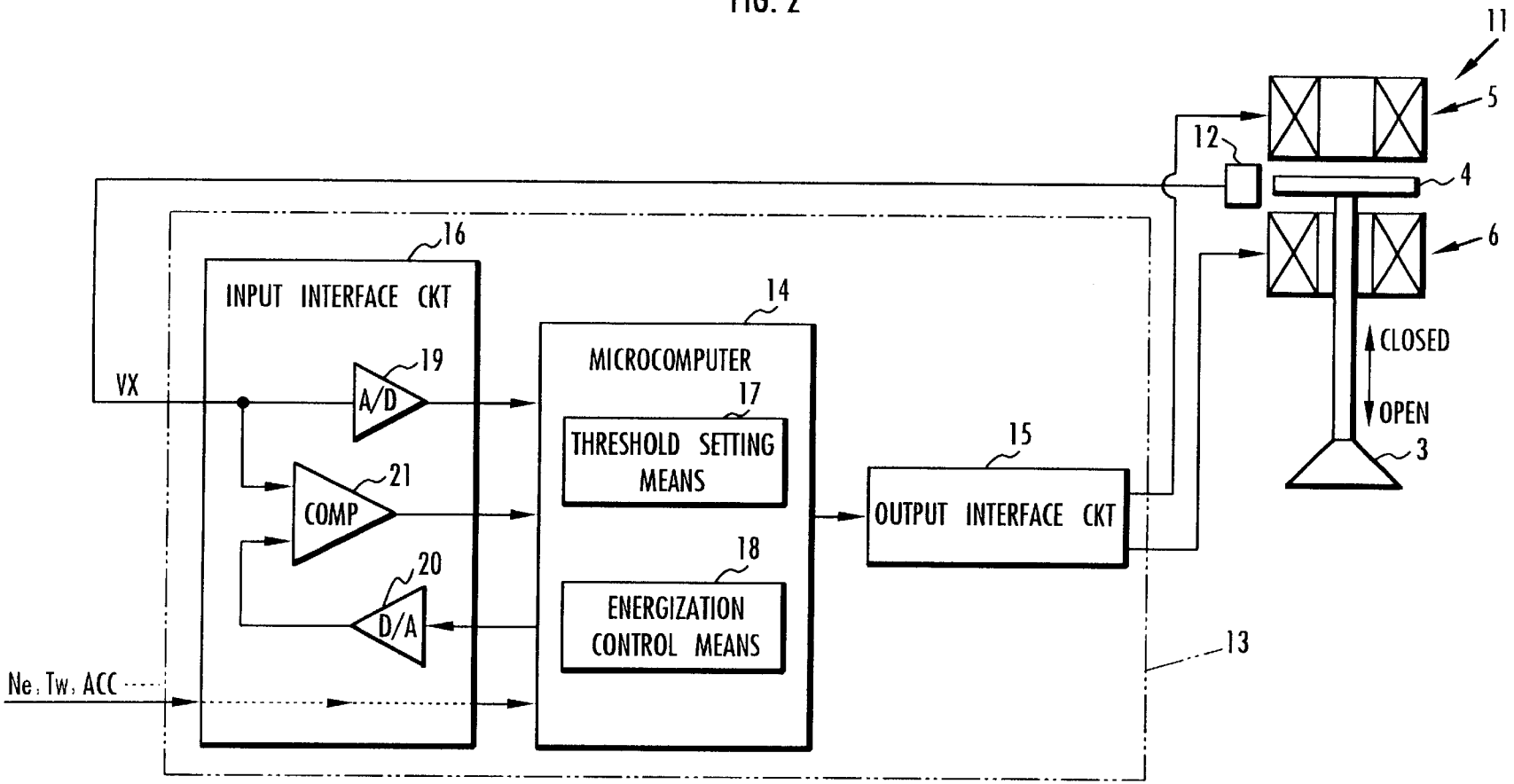
FIG. 2 is a block diagram of a system according to an embodiment of the present invention, for controlling the electromagnetic valve unit shown in FIG. 1.

FIG. 2 shows in block form a system according to an embodiment of the present invention, for controlling an electromagnetic valve unit. In FIG. 2, the system controls an electromagnetic valve unit 11, whose basic structure is identical to the basic structure shown in FIG. 1, for selectively opening and closing an intake/exhaust port 2 of a combustion chamber 1 of each cylinder of an internal combustion engine. The electromagnetic valve unit 11 is schematically shown, with details omitted from illustration, in FIG. 2.

As shown in FIG. 2, the system includes a displacement sensor 12 associated with the electromagnetic valve unit 11, for generating an output Vx depending on the displaced position of the valve head 3 of the electromagnetic valve unit 11, and a controller 13 for controlling the energization of the solenoids 5*a*, 6*a* of the valve-closing and -opening electromagnets 5, 6 in order to control the operation of the electromagnetic valve unit 11. The displacement sensor 12 may comprise an eddy-current-type sensor or a sensor of the type of detecting a change in inductance.

The controller 13 comprises a microcomputer 14 having a CPU, a RAM, and a ROM (not shown), an output interface circuit 15 as a driver circuit for energizing the electromagnets 5, 6 according to commands from the microcomputer 14, and an input interface circuit 16 for supplying various data required by control processes performed by the microcomputer 14, including the output Vx of the displacement sensor 12.

The microcomputer 14 has, as its functions, a threshold setting means 17 for performing a process of setting thresholds, to be described later on, for the output Vx of the displacement sensor 12, and an energization control means 18 for performing a process of controlling the energization of the electromagnets 5, 6.

The input interface circuit 16 has an A/D converter 19 for converting an analog signal representing the output Vx of the displacement sensor 12 into a digital signal and supplying the digital signal to the microcomputer 14, a D/A converter 20 for converting digital data of thresholds set by the microcomputer 14 into analog data, and a comparator 21 for comparing the output of the D/A converter 20, i.e., a level signal representing the thresholds, with the output Vx of the displacement sensor 12, and supplying data depending on the result of comparison to the microcomputer 14.

The microcomputer 14 is supplied with, other than the output Vx of the displacement sensor 12, detected data representing a rotational speed Ne of the internal combustion engine, an engine temperature Tw thereof, an accelerator movement quantity ACC, etc. which are detected by non-illustrated sensors.

Operation of the system shown in FIG. 2, primarily control processes performed by the microcomputer 14, will be described below.

While the internal combustion engine is in operation, the microcomputer 14 sequentially determines target values for the opening and closing action of the valve head 3, i.e., target values in each opening and closing cycles of the valve head 3, from a map based on detected data of the rotational speed Ne, the engine temperature Tw, the accelerator movement quantity ACC, etc. in order to open and close the valve head 3 according to a predetermined pattern depending on the rotational speed Ne, the engine temperature Tw, the accelerator movement quantity ACC, etc. The target values to be determined include a target value for the timing for the valve head 3 to have reached a position displaced a certain distance, e.g., 1 mm, from the closed position toward the open position when the valve head 3 is opened and closed, and a target value for the speed at which the valve head 3 moves when the valve head 3 is opened and closed.

Based on the data of the determined target values and the output Vx of the displacement sensor 12, the microcomputer 14 controls the energization of the electromagnets 5, 6 via the output interface circuit 15, as described below, thereby to control the opening and closing action of the valve head 3.

A process of controlling the energization of the electromagnets 5, 6 will be described below with reference to the timing chart of FIG. 3 and the flowcharts of FIGS. 4 through 11.

In the timing chart of FIG. 3, time-dependent changes of the output Vx of the displacement sensor 12 when the valve head 3 is opened and closed and time-dependent changes of a threshold parameter P, to be described later on, compared with the output Vx are indicated respectively by solid-line and dot-and-dash-line curves in an upper portion of FIG. 3. Operation of timers for measuring various times is shown in a middle portion of FIG. 3. Time-dependent changes of currents passing through the valve-opening electromagnet 6 and the valve-closing electromagnet 5 are shown in a lower portion of FIG. 3.

Figure 3:
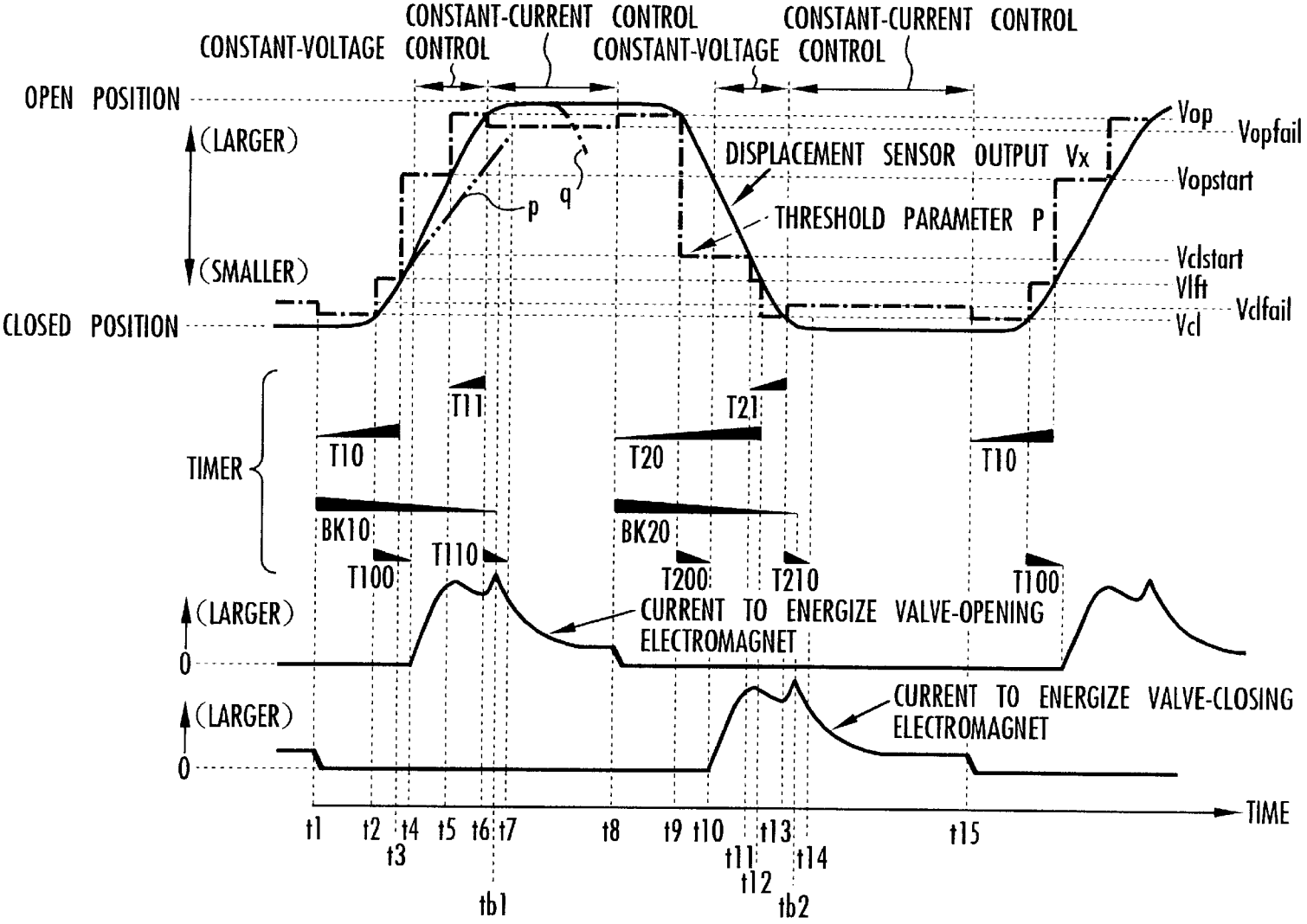
FIG. 3 is a timing chart of an operation sequence of the system shown in FIG. 2.

In the present embodiment, the output Vx of the displacement sensor 12 is minimum when the valve head 3 is in the closed position and maximum when the valve head 3 is in the open position, as indicated by the upper portion of FIG. 3.

Figure 4:
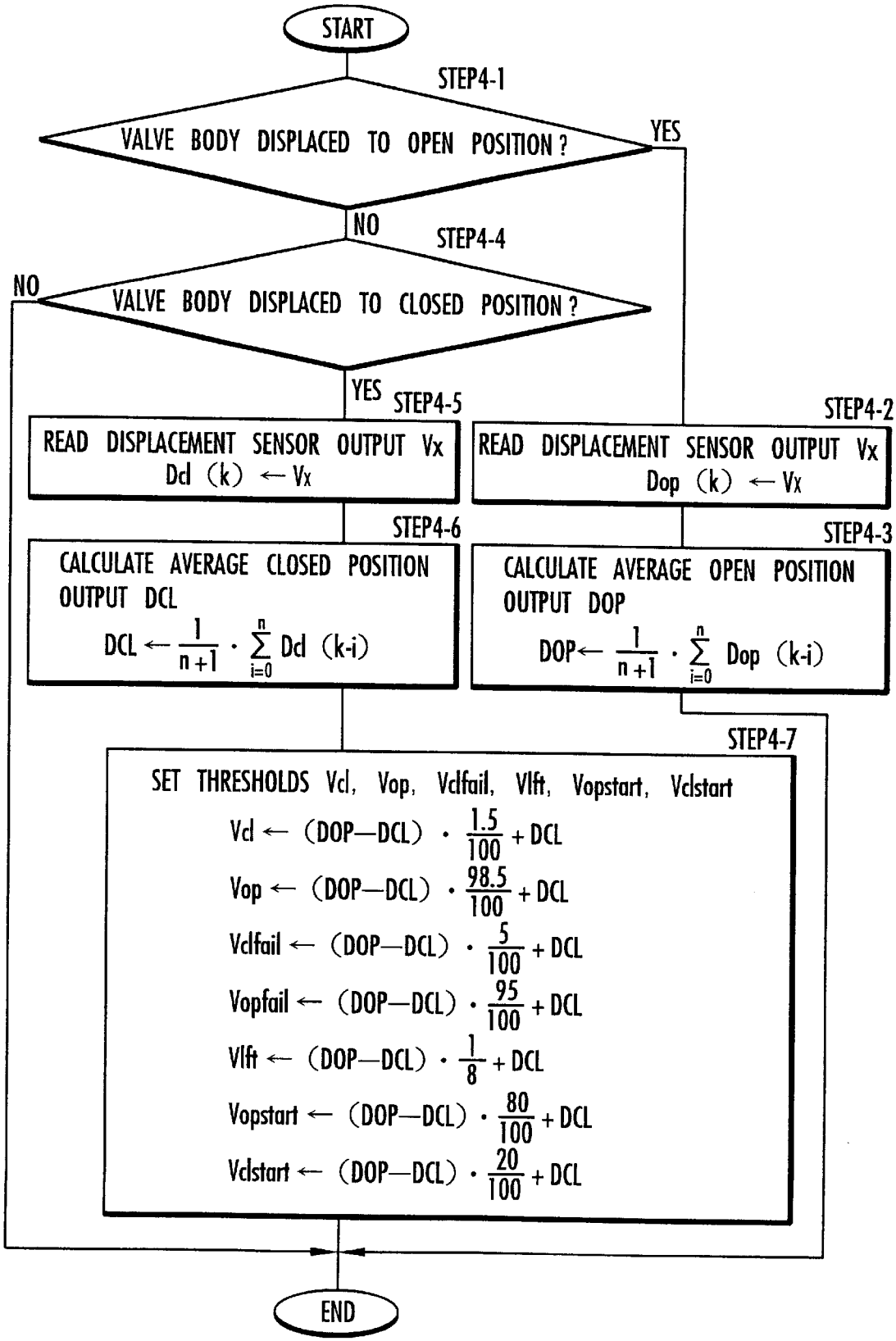
FIG. 4 is a flowchart of a threshold setting process carried out by the system shown in FIG. 2.

While the valve head 3 is being opened and closed, i.e., while the internal combustion engine is in operation, the threshold setting means 17 of the microcomputer 14 performs a threshold setting process shown in FIG. 4 in each control cycle divided from one period of the opening and closing action of the valve head 3, for setting a plurality of thresholds for the output Vx of the displacement sensor 12 in each cycle of the opening and closing action of the valve head 3, more specifically, each time the valve head 3 moves to the closed position.

Specifically, the threshold setting means 17 decides whether the displaced position of the valve head 3 is the open position or not in STEP4-1. If the present time is a predetermined timing immediately prior to the timing (time t8 in FIG. 3) to de-energize the valve-opening electromagnet 6, then the threshold setting means 17 determines that the displaced position of the valve head 3 is the open position.

If the displaced position of the valve head 3 is the open position in STEP4-1, then the threshold setting means 17 reads present data of the output Vx of the displacement sensor 12, i.e., data supplied from the displacement sensor 12 via the A/D converter 19, as output Dop(k) (hereinafter referred to as "open position output Dop(k)") of the displacement sensor 12 in the open position in the present cycle of the opening and closing action of the valve head 3 in STEP4-2. In the open position output Dop(k), the suffix "k" represents the ordinal number of the opening and closing cycle of the valve head 3.

The threshold setting means 17 calculates an average value of the open position output Dop(k) of the displacement sensor 12 in the present opening and closing cycle of the valve head 3, and past data of open position outputs Dop (k−1), Dop(k−2), . . . , Dop(k−n) of the displacement sensor 12 obtained in STEP4-2 in past n opening and closing cycles of the valve head 3, as an average open position output DOP of the displacement sensor 12 in STEP4-3. Stated otherwise, the threshold setting means 17 obtains an average value of the open position outputs Dop(k), . . . , Dop(k−n) in the successive (n+1) opening and closing cycles of the valve head 3 as the average open position output DOP.

If the displaced position of the valve head 3 is not the open position in STEP4-1, then the threshold setting means 17 decides whether the displaced position of the valve head 3 is the closed position or not in STEP4-4. Specifically, the threshold setting means 17 decides whether the present time is a predetermined timing immediately prior to the timing (time t15 in FIG. 3) to de-energize the valve-closing electromagnet 5.

If the displaced position of the valve head 3 is the closed position, then the threshold setting means 17 reads present data of the output Vx of the displacement sensor 12 as output Dcl(k) (hereinafter referred to as "closed position output Dcl(k)") of the displacement sensor 12 in the closed position in the opening and closing cycle of the valve head 3 in STEP4-5. In the closed position output Dcl(k), the suffix "k" represents the ordinal number of the opening and closing cycle of the valve head 3.

Then, the threshold setting means 17 calculates an average value of the open position outputs Dcl(k), . . . , Dcl(k−n) in the successive (n+1) opening and closing cycles of the valve head 3 as an average closed position output DCL in STEP4-6.

In STEP4-1 and STEP4-4, the threshold setting means 17 may also decide whether the output Vx of the displacement sensor 12 falls in a predetermined range or not in order to decide, more reliably, whether the displaced position of the valve head 3 is the open position or not and whether the displaced position of the valve head 3 is the closed position or not.

After having determined the average open position output DOP and the average closed position output DCL, the threshold setting means 17 establishes a plurality of (seven in the present embodiment) thresholds Vcl, Vop, Vclfail, Vopfail, Vlft, Vopstart, Vclstart for the output Vx of the displacement sensor 12, using the output difference (DOP–DCL) between the average open position output DOP and the average closed position output DCL, in STEP4-7.

The threshold Vcl corresponds to a displaced position in the vicinity of the closed position of the valve head 3. More specifically, the threshold Vcl corresponds to the position of valve head 3 which is displaced from the closed position toward the open position by 1.5% of the full displacement, indicated by Y in FIG. 1, of the valve head 3 between the open position and the closed position. In the present embodiment, the full output difference (DOP–DCL) between the average open position output DOP and the average closed position output DCL of the displacement sensor 12 corresponds to the full displacement Y of the valve head 3, and the average closed position output DCL represents a basic value of the actual output Vx of the displacement sensor 12. The threshold setting means 17 obtains a value changed from the average closed position output DCL by 1.5% (the proportion of 1.5/100) of the full output difference (DOP–DCL), as the threshold Vcl according to a corresponding equation indicated in STEP4-7 shown in FIG. 4. As described in detail later on, the threshold Vcl is related to a process of adjusting the timing to energize the valve-closing electromagnet 5 in closing the valve head 3 and a process of switching the energizing pattern of the valve-closing electromagnet 5.

The threshold Vop corresponds to a displaced position in the vicinity of the open position of the valve head 3. More specifically, the threshold Vop corresponds to the position of valve head 3 which is displaced from the closed position toward the open position by 98.5% of the full displacement Y of the valve head 3 between the open position and the closed position, i.e., the position of valve head 3 which is displaced from the open position toward the closed position by 1.5% of the full displacement Y of the valve head 3. In the present embodiment, the threshold setting means 17 obtains a value changed from the average closed position output DCL by 98.5% (the proportion of $^{98.5}/_{100}$) of the full output difference (DOP–DCL), as the threshold vop according to a corresponding equation indicated in STEP7 shown in FIG. 4. As described in detail later on, the threshold Vop is related to a process of adjusting the timing to energize the valve-opening electromagnet 6 in opening the valve head 3 and a process of switching the energizing pattern of the valve-opening electromagnet 6.

The threshold Vclfail corresponds to a position slightly displaced toward the open position from the displaced position of the valve head 3 which corresponds to the threshold Vcl. More specifically, the threshold Vclfail corresponds to the position of valve head 3 which is displaced from the closed position toward the open position by 5% of the full displacement Y of the valve head 3. In the present embodiment, the threshold setting means 17 obtains a value changed from the average closed position output DCL by 5% (the proportion of $^{5}/_{100}$) of the full output difference (DOP–DCL), as the threshold Vclfail according to a corresponding equation indicated in STEP7 shown in FIG. 4. As described in detail later on, the threshold Vclfail is related to a failure process in closing or opening the valve head 3.

The threshold Vopfail corresponds to a position slightly displaced toward the closed position from the displaced position of the valve head 3 which corresponds to the threshold Vop. More specifically, the threshold Vopfail corresponds to the position of valve head 3 which is displaced from the closed position toward the open position by 95% of the full displacement Y of the valve head 3, i.e., the position of valve head 3 which is displaced from the open position toward the closed position by 5% of the full displacement Y of the valve head 3. In the present embodiment, the threshold setting means 17 obtains a value changed from the average closed position output DCL by 95% (the proportion of $^{95}/_{100}$) of the full output difference (DOP–DCL), as the threshold Vopfail according to a corresponding equation indicated in STEP4-7 shown in FIG. 4. As described in detail later on, the threshold Vopfail is related to a failure process in opening or closing the valve head 3.

The threshold Vlft corresponds to a position slightly displaced from the closed position toward the open position by 1 mm, for example. In this embodiment, the full displacement Y of the valve head 3 is 8 mm, for example. Therefore, the position of the valve head 3 which corresponds to the threshold Vlft is a position displaced from the closed position by the proportion of ⅛, i.e., 12.5%, of the full displacement Y. In the present embodiment, the threshold setting means 17 obtains a value changed from the average closed position output DCL by the proportion of ⅛ of the full output difference (DOP–DCL), as the threshold Vlft according to a corresponding equation indicated in STEP4-7 shown in FIG. 4. As described in detail later on, the threshold Vlft is related to a process of adjusting the timing to de-energize the valve-closing electromagnet 5 in opening the valve head 3 and a process of adjusting the timing to de-energize the valve-opening electromagnet 6 in closing the valve head 3.

The threshold Vopstart corresponds to a position displaced from the closed position toward the open position by 80% of the full displacement Y of the valve head 3, i.e., a position displaced from the open position toward the closed position by the proportion of 20% of the full displacement Y of the valve head 3. In the present embodiment, the threshold setting means 17 obtains a value changed from the average closed position output DCL by 80% (the proportion of $^{80}/_{100}$) of the full output difference (DOP–DCL), as the threshold vopstart according to a corresponding equation indicated in STEP7 shown in FIG. 4. As described in detail later on, the threshold vopstart is related to a process of adjusting the timing to energize the valve-opening electromagnet 6.

The threshold Vclstart corresponds to a position displaced from the closed position toward the open position by 20% of the full displacement Y of the valve head 3. In the present embodiment, the threshold setting means 17 obtains a value changed from the average closed position output DCL by 20% (the proportion of $^{20}/_{100}$) of the full output difference (DOP–DCL), as the threshold Vclstart according to a corresponding equation indicated in STEP7 shown in FIG. 4. As described in detail later on, the threshold Vclstart is related to a process of adjusting the timing to energize the valve-closing electromagnet 5.

In this fashion, the threshold setting means 17 establishes the thresholds Vcl, Vop, Vclfail, Vopfail, Vlft, Vopstart, Vclstart for the output Vx of the displacement sensor 12 in each period of the opening and closing action of the valve head 3, i.e., each time the valve head 3 is closed.

Since the thresholds Vcl, Vop, Vclfail, Vopfail, Vlft, Vopstart, Vclstart are established according to corresponding proportions of the displaced positions of the valve head 3 with respect to the full output difference (DOP–DCL), which are determined in each period of the opening and closing action of the valve head 3, the thresholds corresponding to the desired displaced positions of the valve head 3 can be established reliably irrespectively of variations of the output characteristics of individual displacement sensors 12 and time-dependent changes in the characteristics of the displacement sensor 12.

The thresholds established in each opening and closing cycle of the valve head 3 are used as values of the threshold parameter P (see FIG. 3) to be compared with the output Vx of the displacement sensor 12 in the opening and closing action in a next cycle of the valve head 3.

In this embodiment, the entire the difference (DOP–DCL) between the average open position output DOP and the average closed position output DCL is used to determine the above thresholds. However, the difference (Dop–Dcl) between the open position output Dop determined in STEP4-2 and the closed position output Dcl determined in STEP4-5 in each opening and closed cycle of the valve head 3 may instead be used to determine the above thresholds. However, using the entire the difference (DOP–DCL) between the average open position output DOP, which is the average value of open position outputs Dop of the displacement sensor 12 over a plurality of opening and closing cycles of the valve head 3, and the average closed position output DCL, which is the average value of closed position outputs Dcl of the displacement sensor 12 over a plurality of opening and closing cycles of the valve head 3, is capable of compensating for the effect of temporary noise components which may be contained in the output Vx of the displacement sensor 12 for increasing the reliability of the above thresholds.

In an opening and closing cycle of the valve head 3, i.e., in a cycle of opening the valve head 3 from the closed position and then closing the valve head 3 again, following the period of establishing the thresholds Vcl, Vop, Vclfail, Vopfail, Vlft, Vopstart, Vclstart for the output Vx of the displacement sensor 12, the energization control means 18 of the microcomputer 14 performs a process of controlling the energization of the electromagnets 5, 6 using those established thresholds. This process is carried out in each control cycle divided from one period of the opening and closing action of the valve head 3, as is the case with the threshold setting process.

Figure 5:
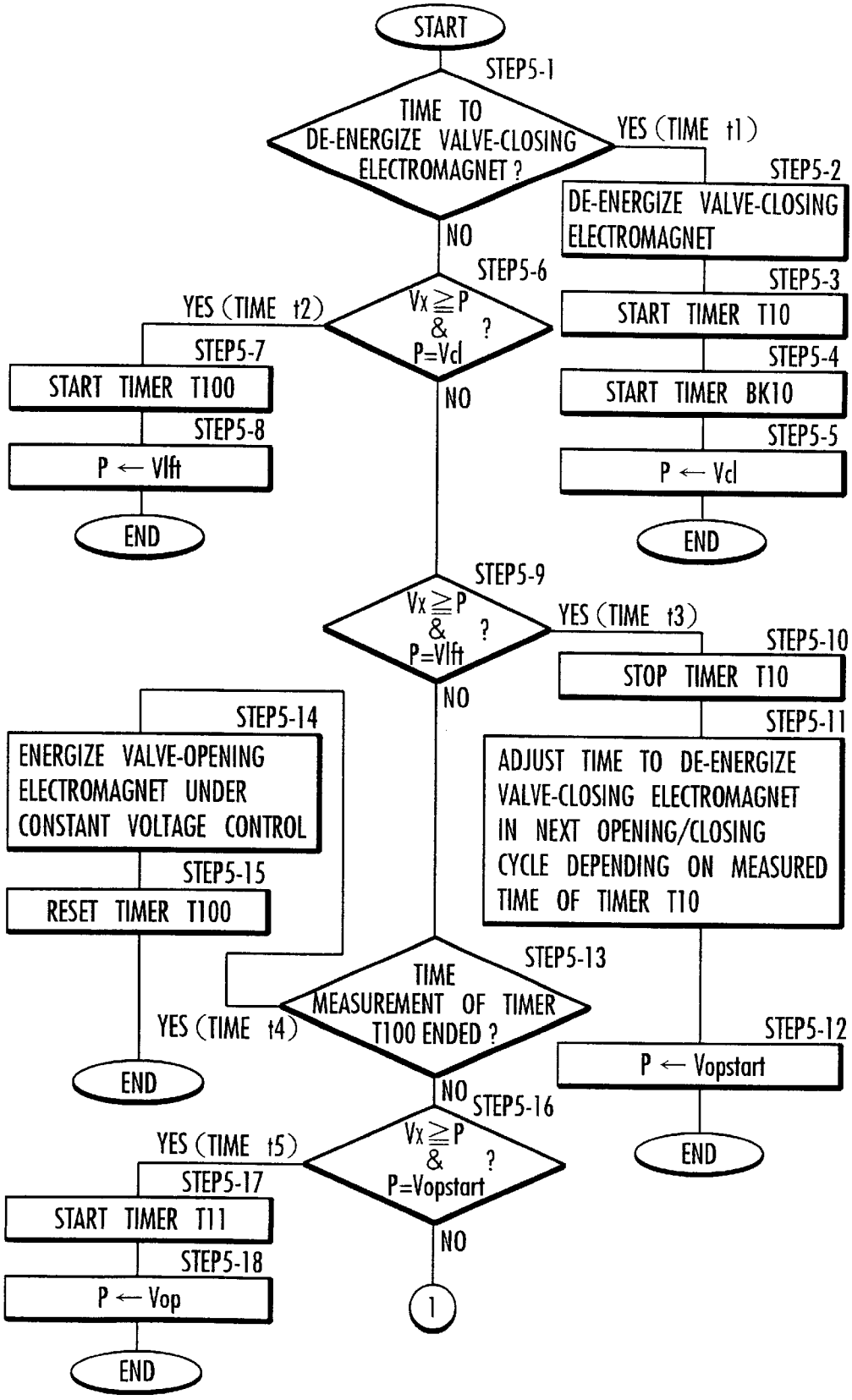
FIGS. 5 and 6 are a flowchart of a process of opening the electromagnetic valve unit, which is carried out by the system shown in FIG. 2.
Figure 6:
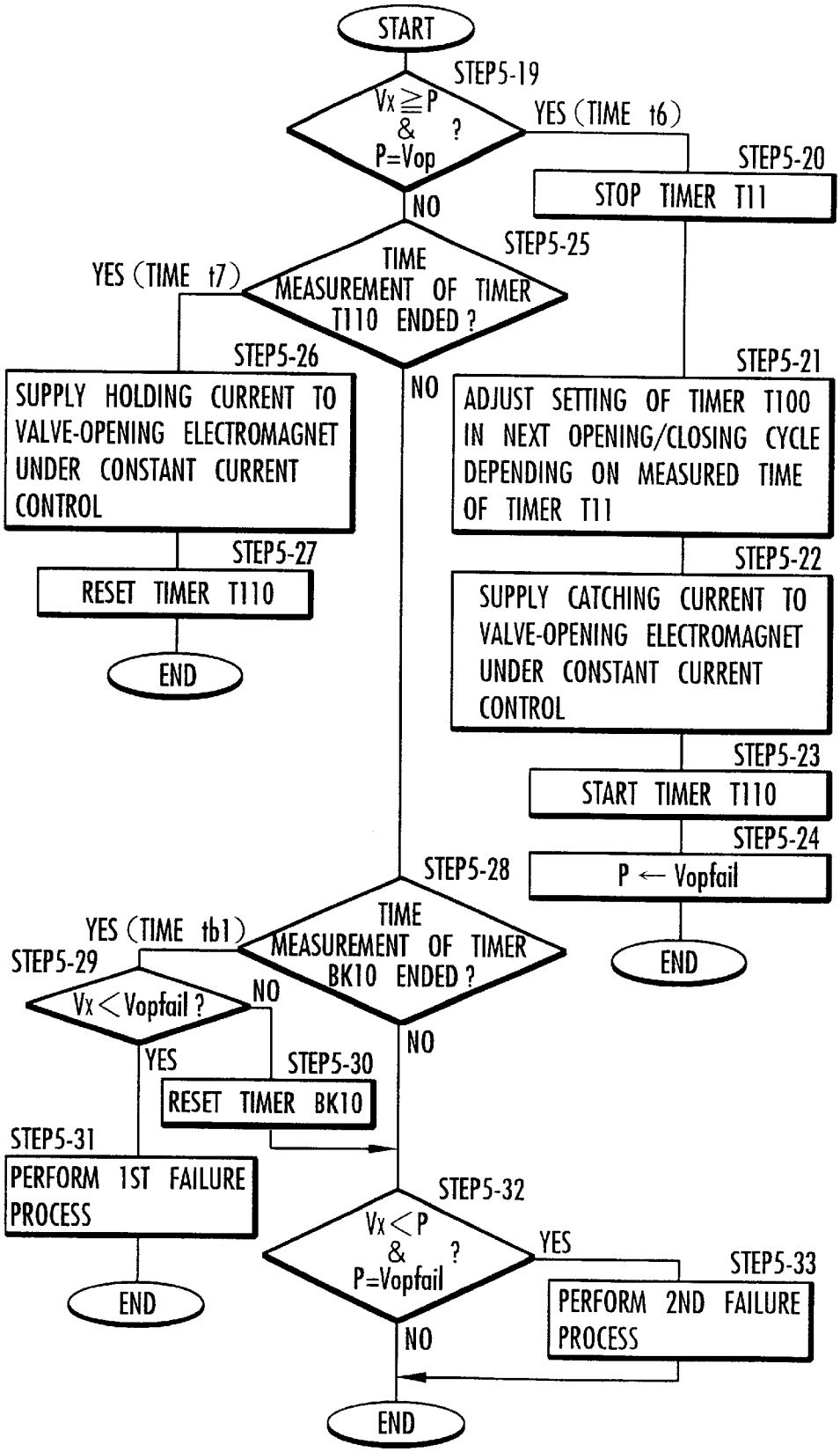

First, the energization control means 18 executes a process of opening the valve head 3 in the above control cycles according to the flowchart of FIGS. 5 and 6. The energization control means 18 decides whether the present time is a timing to de-energize the valve-closing electromagnet 5 or not in STEP5-1 shown in FIG. 5. The timing to de-energize the valve-closing electromagnet 5 is determined, as described later on, by the energization control means 18 in the preceding opening and closing cycle.

If the present time is a timing to de-energize the valve-closing electromagnet 5 (time t1 in FIG. 3), then the energization control means 18 de-energizes the valve-closing electromagnet 5 via the output interface circuit 15 as indicated in the lower portion of FIG. 3 in STEP5-2. Then, the energization control means 18 starts timers T10, BK10 shown in the middle portion of FIG. 3 in STEP5-3, STEP5-4. The timer T10 is a count-up timer for measuring a time from the de-energization of the valve-closing electromagnet 5 until the valve head 3 is displaced 1 mm toward the open position. The timer BK10 is a count-down timer for measuring a preset time relative to a failure process that is carried out upon a malfunction, described later on, of the valve head 3. The preset time is determined from a map based on the rotational speed Ne, the accelerator movement quantity ACC, the engine temperature Tw, etc.

Then, as shown in the upper portion of FIG. 3, the energization control means 18 sets the threshold Vcl, among the seven thresholds established in the preceding opening and closing cycle, as the value of the threshold parameter P to be compared with the output Vx of the displacement sensor 12, in STEP5-5. Thereafter, the process in the present control cycle is put to an end.

According to the processing in STEP5-2, the electromagnetic forces generated by the valve-closing electromagnet 5 are eliminated. Therefore, the valve head 3 starts moving from the closed position toward the open position under the combined biasing forces of the springs 7, 8. Generally, the valve head 3 starts moving with a slight delay from the de-energization of the valve-closing electromagnet 5 because of electromagnetic forces remaining immediately after the valve-closing electromagnet 5 is de-energized and the internal pressure in the combustion chamber 1.

Then, the energization control means 18 decides whether or not the output Vx of the displacement sensor 12 is equal to or greater than the present value of the threshold parameter P and the value of the threshold parameter P is the threshold Vcl or not in STEP5-6. Stated otherwise, after the processing in STEP5-2 through STEP5-5, the energization control means 18 decides whether the present time is a timing for the output Vx of the displacement sensor 12 to have reached the threshold Vcl, i.e., whether the present time is a timing for the valve head 3 to have reached the displaced position corresponding to the threshold Vcl, i.e., the position which is displaced from the closed position by 1.5% of the full displacement Y, or not.

If the present time is a timing for the output Vx of the displacement sensor 12 to have reached the threshold Vcl (t2 in FIG. 3), then the energization control means 18 starts a timer T100 shown in the middle portion of FIG. 3 in STEP5-7. The timer T100 is a timer for determining a timing to energize the valve-opening electromagnet 6 and a count-down timer for measuring a preset time. The preset time (initial value) for the timer T100 is determined, as described later on, in the preceding opening and closing cycle of the valve head 3.

Then, the energization control means 18 sets the threshold Vlft, among the seven thresholds established in the preceding opening and closing cycle, as the value of the threshold parameter P, as shown in the upper portion of FIG. 3, in STEP5-8. Thereafter, the process in the present control cycle is put to an end.

Thereafter, the energization control means 18 decides whether or not the output Vx of the displacement sensor 12 is equal to or greater than the present value of the threshold parameter P and the value of the threshold parameter P is the threshold Vlft or not in STEP5-9. Stated otherwise, after the processing in STEP5-7, STEP5-8, the energization control means 18 decides whether the present time is a timing for the valve head 3 to have reached the displaced position corresponding to the threshold Vlft, i.e., the position which is displaced from the closed position by 1 mm, or not.

If the present time is a timing for the output Vx of the displacement sensor 12 to have reached the threshold Vlft (t3 in FIG. 3), then the energization control means 18 stops the timer T10 that has been started in STEP5-3 in STEP5-10. Therefore, the time that has elapsed from the de-energization of the valve-closing electromagnet 5 until the valve head 3 is displaced 1 mm toward the open position is measured.

Depending on the time measured by the timer T10, the energization control means 18 adjusts the timing to de-energize the valve-closing electromagnet 5 in a next opening and closing cycle of the valve head 3 and determines the timing in STEP5-11.

More specifically, in the next opening and closing cycle of the valve head 3, the energization control means 18 adjusts the timing to de-energize the valve-closing electromagnet 5 depending on the time measured by the timer T10 so that the timing for the valve head 3 to be displaced 1 mm from the open position becomes a target timing determined from the rotational speed Ne, the accelerator movement quantity ACC, the engine temperature Tw, etc. Specifically, if the rotational speed Ne, the accelerator movement quantity ACC, etc. are constant, then a time which precedes the target timing by the time measured by the timer T10 is established as the timing to de-energize the valve-closing electromagnet 5 in the next opening and closing cycle. Thus, the timing to de-energize the valve-closing electromagnet 5 becomes earlier as the time measured by the timer T10 is longer, and becomes later as the time measured by the timer T10 is shorter.

After having determined the timing to de-energize the valve-closing electromagnet 5 in the next opening and closing cycle, the energization control means 18 sets the threshold Vopstart, among the seven thresholds established in the preceding opening and closing cycle, as the value of the threshold parameter P, in STEP5-12. Thereafter, the process in the present control cycle is put to an end.

Then, the energization control means 18 decides whether the process of the timer T100 to measure the preset time, which has started in STEP5-7, is ended or not, i.e., whether the count of the timer T100 has become "0" or not in STEP5-13.

If the process of the timer T100 to measure the preset time is ended (time t4 in FIG. 3), then the energization control means 18 starts energizing the valve-opening electromagnet 6 in a constant-voltage control mode in STEP5-14. Specifically, when the preset time of the timer T100 has elapsed after the valve head 3 has reached the displaced position corresponding to the threshold Vcl, i.e., the position which is displaced from the open position by 1.5% of the full displacement Y, the energization control means 18 energizes the solenoid 6*a* of the valve-opening electromagnet 6 while applying a constant voltage to the solenoid 6*a*.

When the valve-opening electromagnet 6 is energized in the constant-voltage control mode, the current flowing through the valve-opening electromagnet 6 increases as the valve head 3 moves, as indicated in the lower portion of FIG. 3, thus increasing electromagnetic forces of the electromagnet 6 for smoothly moving the valve head 3 toward the open position.

After having energized the valve-opening electromagnet 6, the energization control means 18 resets the timer T100 in STEP5-15, and the process in the present control cycle is put to an end. In STEP5-15, the energization control means 18 resets the timer T100 to the preset time, which the timer T100 has started to measure in STEP5-7.

Thereafter, the energization control means 18 decides whether or not the output Vx of the displacement sensor 12 is equal to or greater than the present value of the threshold parameter P and the value of the threshold parameter P is the threshold Vopstart or not in STEP5-16. Stated otherwise, after the processing in STEP5-10 through STEP5-12, the energization control means 18 decides whether the present time is a timing for the valve head 3 to have reached the displaced position corresponding to the threshold Vopstart, i.e., the position which is displaced from the closed position by 80% of the full displacement Y, or not.

If the present time is a timing for the output Vx of the displacement sensor 12 to have reached the threshold Vopstart (t5 in FIG. 3), then the energization control means 18 starts a timer T11 shown in the middle portion of FIG. 3 in STEP5-17. The timer T11 is a count-up timer for measuring a time for the valve head 3 to reach the displaced position corresponding to the threshold Vop, i.e., the position of valve head 3 which is displaced from the closed position toward the open position by 98.5% of the full displacement Y of the valve head 3, from the displaced position corresponding to the threshold Vopstart, as representing a speed at which the valve head 3 moves when it is opened.

Then, the energization control means 18 sets the threshold Vop, among the seven thresholds established in the preceding opening and closing cycle, as the value of the threshold parameter P in STEP5-18. Thereafter, the process in the present control cycle is put to an end.

Thereafter, the energization control means 18 decides whether or not the output Vx of the displacement sensor 12 is equal to or greater than the present value of the threshold parameter P and the value of the threshold parameter P is the threshold Vop or not in STEP5-19 shown in FIG. 6. Stated otherwise, after the processing in STEP5-17, STEP5-18, the energization control means 18 decides whether the present time is a timing for the valve head 3 to have reached the displaced position corresponding to the threshold Vop, i.e., the position which is displaced from the closed position by 98.5% of the full displacement Y, or not.

If the present time is a timing for the output Vx of the displacement sensor 12 to have reached the threshold Vop (time t6 shown in FIG. 3), then the energization control means 18 stops the timer T11 that has been started in STEP5-17 in STEP5-20.

Since the time measured by the timer T11 is a time required for the valve head 3 to have moved from the displaced position corresponding to the threshold Vopstart, i.e., the position of valve head 3 which is displaced from the closed position toward the open position by 80% of the full displacement Y of the valve head 3, to the displaced position corresponding to the threshold vop, i.e., the position of valve head 3 which is displaced from the closed position toward the open position by 98.5% of the full displacement Y of the valve head 3, the time measured by the timer T11 represents a speed at which the valve head 3 moves between these displaced positions.

Depending on the time measured by the timer T11, the energization control means 18 adjusts the preset time of the timer T100 which determines the timing to energize the valve-opening electromagnet 6 in the next opening and closing cycle of the valve head 3, thus determining a timing to energize the valve-opening electromagnet 6 in STEP5-21.

More specifically, the energization control means 18 adjusts the preset time of the timer T100 in the next opening and closing cycle of the valve head 3 so that the speed of the valve head 3 represented by the time measured by the timer T11 becomes a target value for the speed determined from a map based on the rotational speed Ne, the accelerator movement quantity ACC, the engine temperature Tw, etc. For example, if the speed of the valve head 3 represented by the time measured by the timer T11 is higher than the target value, then the energization control means 18 sets the preset time of the timer T100 in the next opening and closing cycle to a value longer than the present preset time. In this manner, when the valve head 3 is opened in the next opening and closing cycle, the timing to energize the valve-opening electromagnet 6, i.e., the timing to generate electromagnetic forces of the valve-opening electromagnet 6, becomes later than the timing in the present opening and closing cycle, lowering the speed of the valve head 3 toward the target value therefor. Conversely, if the speed of the valve head 3 represented by the time measured by the timer T11 is lower than the target value, then the energization control means 18 sets the preset time of the timer T100 in the next opening and closing cycle to a value shorter than the present preset time. In this manner, when the valve head 3 is opened in the next opening and closing cycle, the timing to energize the valve-opening electromagnet 6 becomes earlier than the timing in the present opening and closing cycle, increasing the speed of the valve head 3 toward the target value therefor.

The energization control means 18 then changes the energizing pattern of the valve-opening electromagnet 6 from the constant-voltage control mode to a constant-current control mode in which a constant current is supplied to the valve-opening electromagnet 6, and supplies a catching current to the valve-opening electromagnet 6 in the constant-current control mode in STEP5-22. The catching current is a current supplied to the valve-opening electromagnet 6 with a relatively large target value for the current in the constant-current control mode. By supplying the catching current to the valve-opening electromagnet 6, the valve head 3 can smoothly reach the open position.

Then, the energization control means 18 starts a timer T110 shown in the middle portion of FIG. 3 in STEP5-23. The timer T110 is a count-down timer for measuring a preset time for which the catching current is to be continuously supplied to the valve-opening electromagnet 6.

Then, the energization control means 18 sets the threshold Vopfail, among the seven thresholds established in the preceding opening and closing cycle, as the value of the threshold parameter P in STEP5-24. Thereafter, the process in the present control cycle is put to an end.

Then, the energization control means 18 decides whether the process of the timer T110 to measure the preset time, which has started in STEP5-23, is ended or not, i.e., whether the count of the timer T110 has become "0" or not in STEP5-25.

If the process of the timer T110 to measure the preset time is ended (time t7 in FIG. 3), then the energization control means 18 changes the current supplied to the valve-opening electromagnet 6 in the constant-current control mode to a holding current in STEP5-26. The holding current is a current supplied to the valve-opening electromagnet 6 with a relatively small target value for the current in the constant-current control mode. The holding current is of a level sufficient to hold the valve head 3 in the open position. Specifically, when the preset time of the timer T100 has elapsed after the catching current has started to be supplied to the valve-opening electromagnet 6 in the constant-current control mode, as described above, the valve head 3 has basically been moved fully to the open position. In order to keep the valve head 3 in the open position, the valve-opening electromagnet 6 only needs to produce relatively small electromagnetic forces. To minimize the power consumption by the valve-opening electromagnet 6, therefore, after the preset time of the timer T110 has elapsed, the energization control means 18 supplies the valve-opening electromagnet 6 with a relatively low holding current to keep the valve head 3 in the open position (see the current supplied to energize the valve-opening electromagnet 6 in the lower portion of FIG. 3).

After having changed the current supplied to the valve-opening electromagnet 6 to the holding current, the energization control means 18 resets the timer T110 to its preset time in STEP5-27. Thereafter, the process in the present control cycle is put to an end.

Then, the energization control means 18 decides whether the process of the timer BK10 to measure the preset time, which has started in STEP5-4, is ended or not, i.e., whether the count of the timer BK10 has become "0" or not in STEP5-28.

If the process of the timer BK10 to measure the preset time is ended (time tb1 in FIG. 3), then the energization control means 18 decides whether the present output Vx of the displacement sensor 12 has reached the threshold Vopfail, among the seven thresholds established in the preceding opening and closing cycle, or not in STEP5-29. Stated otherwise, the energization control means 18 decides whether the valve head 3 has moved to the displaced position corresponding to the threshold Vopfail, i.e., the position of valve head 3 which is displaced from the closed position toward the open position by 95% of the full displacement Y of the valve head 3, within the preset time of the timer BK10, or not.

Normally, within the preset time of the timer BK10, the valve head 3 has moved to a position closer to the open position than the displaced position corresponding to the threshold Vopfail, or basically a position closer to the open position than the displaced position corresponding to the threshold Vop. Therefore, $Vx \geqq Vopfail$ in STEP5-29. In this case, the energization control means 18 resets the timer BK10 to the preset time, which the timer BK10 has started to measure in STEP5-4, in STEP5-30. Then, control goes to STEP5-32, to be described later on.

If the valve head 3 has not reached the displaced position corresponding to the threshold Vopfail when the process of the timer BK10 to measure the preset time is not ended, e.g., if the valve head 3 is displaced according to a pattern indicated by the imaginary line p in the upper portion of FIG. 3 due to some malfunction, then $Vx < Vopfail$ in STEP5-29. In this case, the energization control means 18 executes a predetermined first failure process in STEP5-31.

Figure 7:
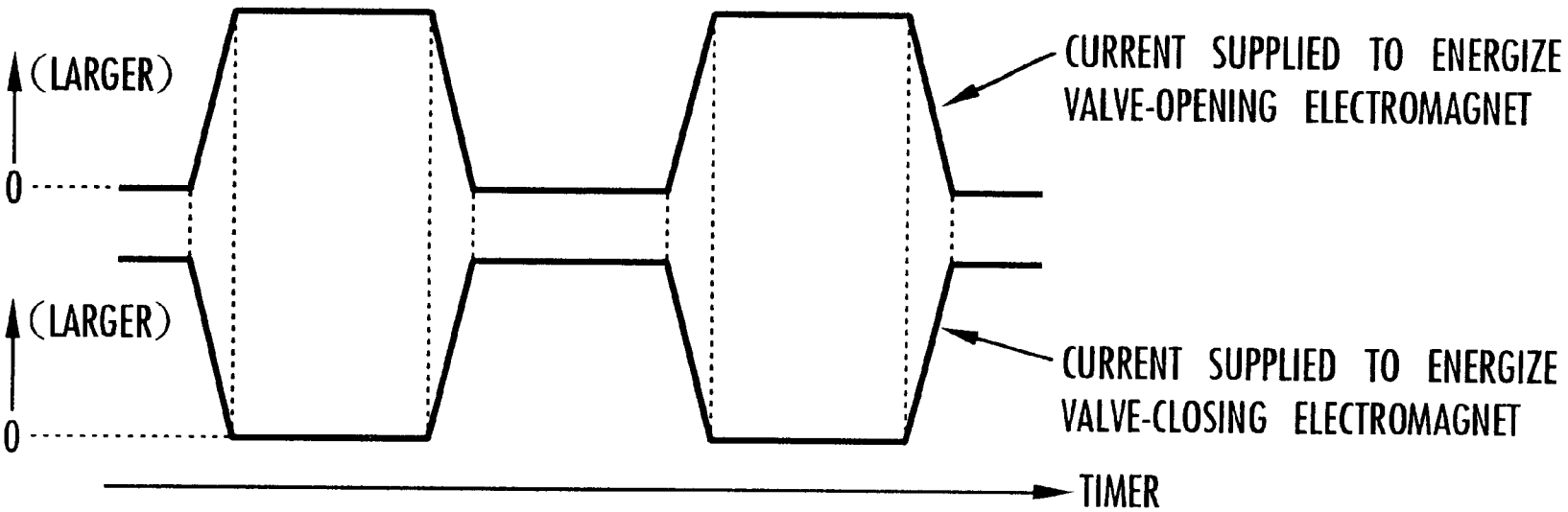
FIG. 7 is a timing chart of a subroutine of the process shown in FIG. 6.

In the first failure process, the energization control means 18 interrupts the process of controlling the energization of the electromagnets 5, 6 for normally opening and closing the valve head 3, but periodically repeats the alternate energization with constant currents of the electromagnets 5, 6 as shown in FIG. 7. The period in which the electromagnets 5, 6 are energized, i.e., electromagnetic forces of the electromagnets 5, 6 are generated, corresponds to the natural frequency (resonant frequency) of the mechanical vibration system that is made up of the valve head 3, the springs 7, 8, and the armature 4.

By thus alternately energizing the electromagnets 5, 6, the valve head 3 can be displaced to the open position or the closed position due to the resonance of the mechanical vibration system. If the valve head 3 is moved to and held in the open position, as confirmed by the output Vx of the displacement sensor 12, when one of the electromagnets 5, 6, e.g., the valve-closing electromagnet 6, is energized, then the first failure process if finished, and the energization control means 18 resumes the process of controlling the energization of the electromagnets 5, 6 for normally opening and closing the valve head 3.

During the execution of the first failure process, the combustion of the air-fuel mixture in the combustion chamber with the valve head 3 is interrupted, and the internal combustion engine is operated by the combustion of the air-fuel mixture in the other combustion chambers.

In a situation where the first failure process is not executed, the energization control means 18 decides whether or not the output Vx of the displacement sensor 12 is equal to or greater than the present value of the threshold parameter P and the value of the threshold parameter P is the threshold Vopfail or not in STEP5-32. Stated otherwise, after the processing in STEP5-20 through STEP5-24, or basically after the valve head 3 has reached the open position and while the valve-opening electromagnet 6 is being energized, the energization control means 18 decides whether the valve head 3 has reached the displaced position corresponding to the threshold Vopfail, i.e., the position which is displaced from the closed position by 95% of the full displacement Y, or not in STEP5-32.

Because normally the valve head 3 is kept in the open position by the holding current of the valve-opening electromagnet 6, the condition in STEP5-32 is not satisfied. In this case, therefore, the process in the present control cycle is put to an end.

If the valve head 3 has been displaced to the position corresponding to the threshold Vopfail in STEP5-32, e.g., if the valve head 3 is displaced from the open position to the closed position according to a pattern indicated by the imaginary line q in the upper portion of FIG. 3 due to some malfunction, then the condition in STEP5-32 is satisfied. In this case, the energization control means 18 executes a predetermined second failure process in STEP5-33.

Figure 8:
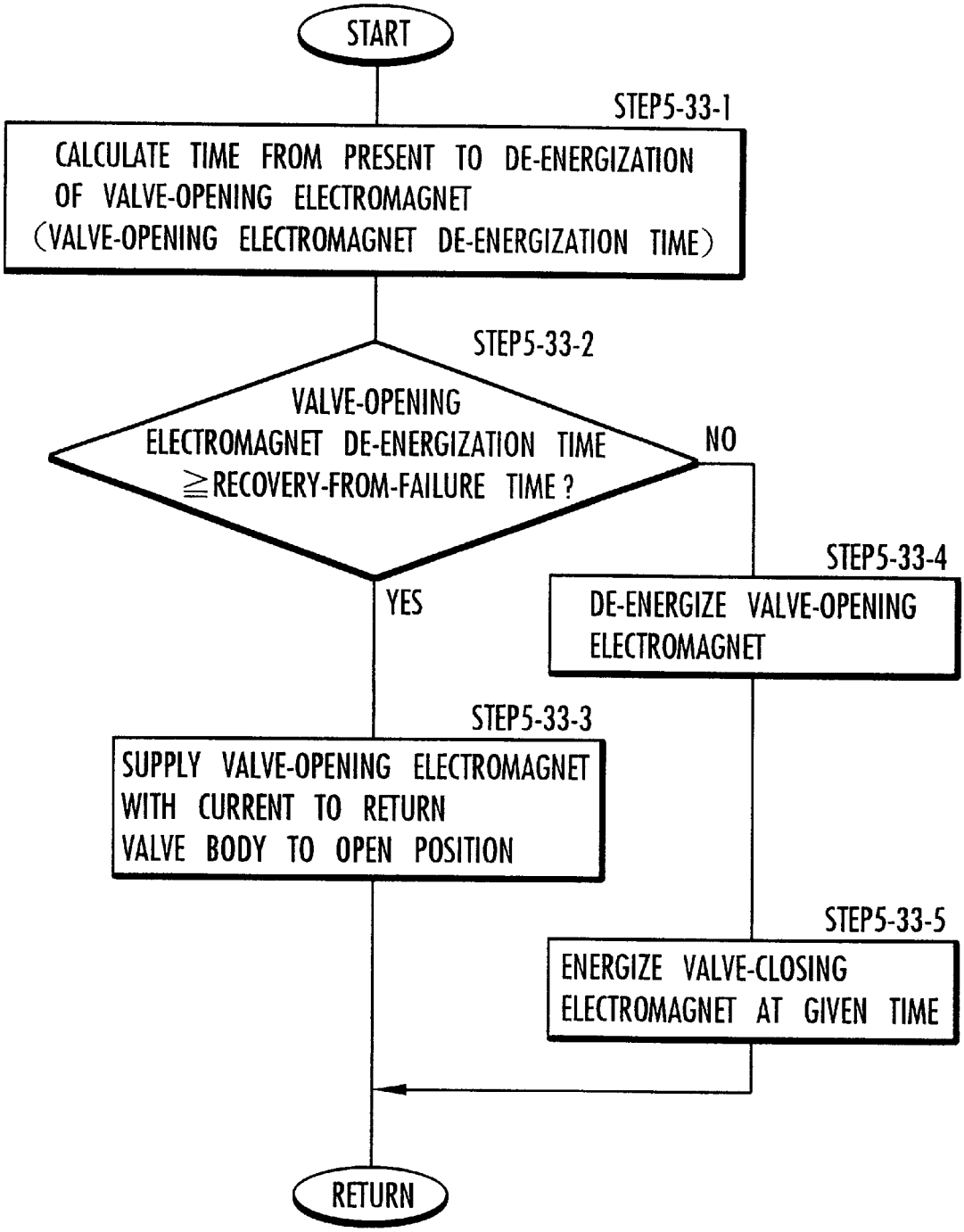
FIG. 8 is a flowchart of a subroutine of the process shown in FIG. 6.

The second failure process will be described in detail below with reference to FIG. 8. The energization control means 18 calculates a time from the present time to the timing to de-energize the valve-opening electromagnet 6, which timing is determined in the preceding opening and closing cycle in the same manner as with the timing to de-energize the valve-closing electromagnet 5, as a valve-opening electromagnet de-energization time in STEP5-33-1. Then, the energization control means 18 compares the calculated valve-opening electromagnet de-energization time with a predetermined recovery-from-failure time that is determined as a time required for the valve head 3 to return to the open position when the valve-opening electromagnet 6 is energized in the displaced position of the valve head 3 corresponding to the threshold Vopfail in STEP5-33-2.

If the valve-opening electromagnet de-energization time is equal to or longer than the recovery-from-failure time, then the energization control means 18 energizes the valve-closing electromagnet 6 to generate electromagnetic forces to return the valve head 3 to the open position in the recovery-from-failure time in STEP5-33-3. In this case, the energization control means 18 supplies the valve-opening electromagnet 6 with the catching current or a current greater than the catching current.

If the above processing is executed, after the timing to de-energize the valve-opening electromagnet 6, a process of normally closing the valve head 3, whose specific details will be described later on, is carried out.

If the valve-opening electromagnet de-energization time is shorter than the recovery-from-failure time in STEP5-33-2, then the energization control means 18 de-energizes the valve-opening electromagnet 6 in STEP5-33-4, and thereafter energizes the valve-closing electromagnet 5 at a given timing in STEP5-33-5 to move the valve head 3 to the closed position. More specifically, the energization control means 18 determines a timing to energize the valve-closing electromagnet 5 for the valve head 3 to reach a position displaced 1 mm from the closed position toward the open position at a timing in the vicinity of a target timing, which is determined depending on the rotational speed Ne, the accelerator movement quantity ACC, the engine temperature Tw, etc., for the valve head 3 to reach the above position displaced 1 mm from the closed position toward the open position when the valve head 3 is closed.

If the above processing is executed, until the valve head 3 moves to the closed position, the process of normally closing the valve head 3 is interrupted. The above recovery-from-failure time may be determined using a data table or the like from the output Vx of the displacement sensor 12 at the time of executing the processing in STEP5-33-2.

The process of opening the valve head 3 has been described above. Now, a process of closing the valve head 3 will be described below. The process of closing the valve head 3 is carried out in the same control cycles as the process of opening the valve head 3 according to the flowchart of FIGS. 9 and 10. Since basic details of the process of closing the valve head 3 are identical to those of the process of opening the valve head 3, the process of closing the valve head 3 will briefly be described below.

Figure 9:
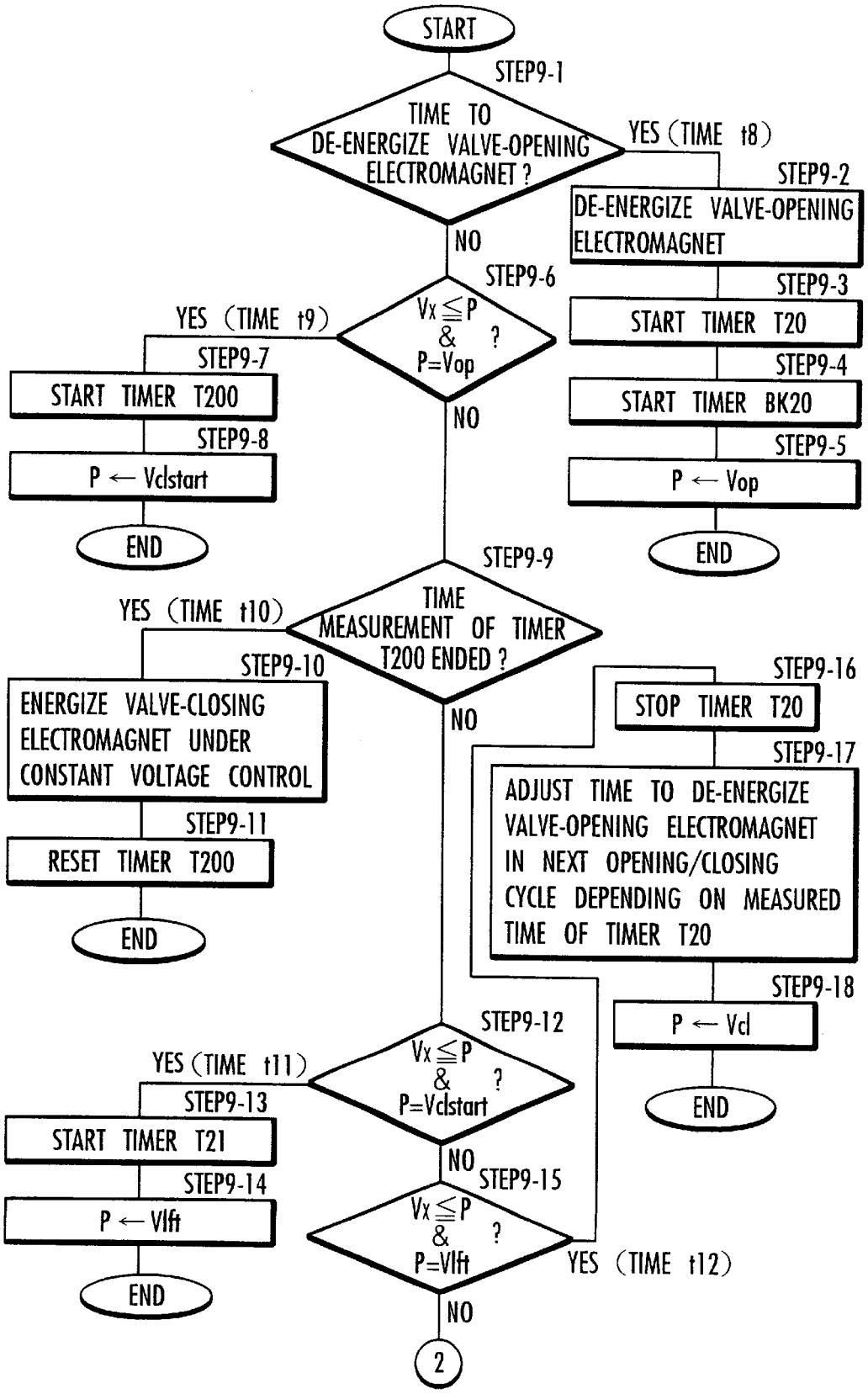
FIGS. 9 and 10 are a flowchart of a process of closing the electromagnetic valve unit, which is carried out by the system shown in FIG. 2.
Figure 10:
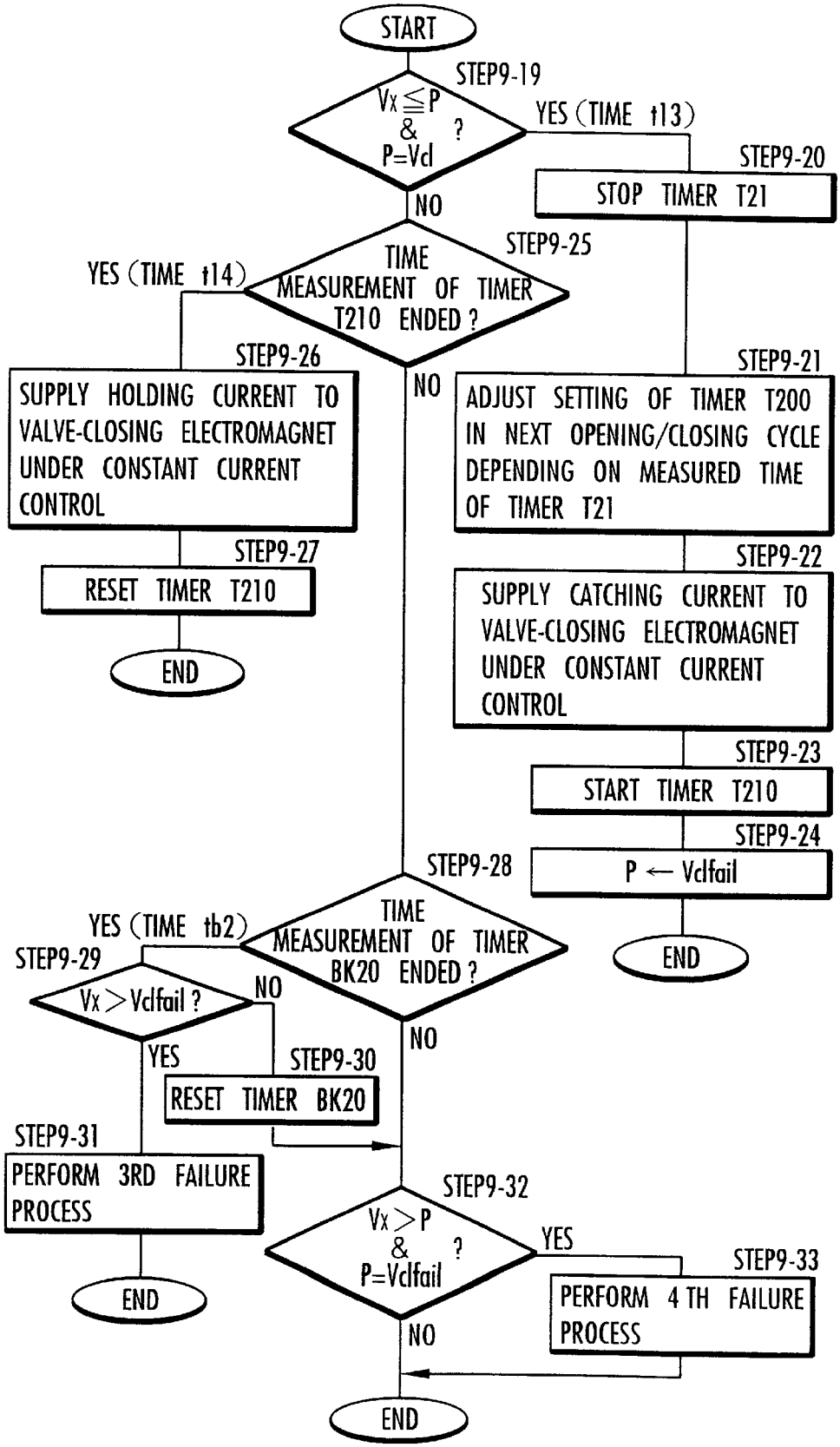
Figure 11:
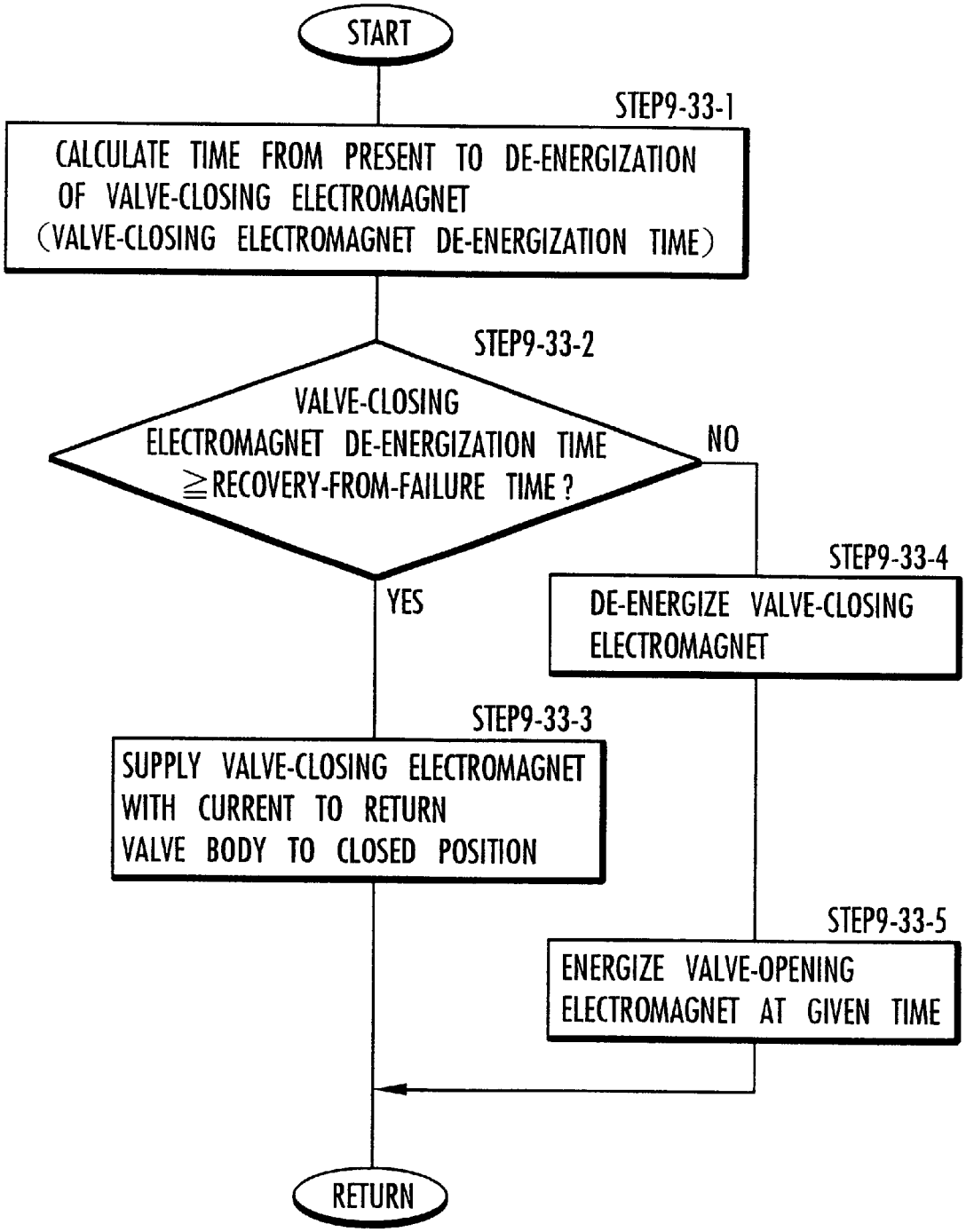
FIG. 11 is a flowchart of a subroutine of the process shown in FIG. 10.

If the present time is a timing to de-energize the valve-opening electromagnet 6 (time t8 in FIG. 3) in STEP9-1 shown in FIG. 9, then the energization control means 18 performs the same processing as in STEP5-2 through STEP5-5 in STEP9-2 through 9-5. Specifically, the energization control means 18 de-energizes the valve-opening electromagnet 6, and starts a timer T20 and a timer BK20 shown in the middle portion of FIG. 3. The energization control means 18 sets the threshold vop corresponding to the position of the valve head 3 displaced from the closed position by 98.5% of the full displacement Y, as the value of the threshold parameter P.

The timing to de-energize the valve-opening electromagnet 6 has been determined, as described later on, in the preceding opening and closing timing in the same manner as with the timing to de-energize the valve-closing electromagnet 5. The timer T20 is a count-up timer for measuring a time from the de-energization of the valve-opening electromagnet 6 until the valve head 3 is displaced 1 mm toward the open position. The timer BK20 is a count-down timer for measuring a preset time relative to a failure process that is carried out upon a malfunction of the valve head 3. The preset time is determined from a map based on the rotational speed Ne, the accelerator movement quantity ACC, the engine temperature Tw, etc.

If the output Vx of the displacement sensor 12 drops to the present threshold parameter P and the threshold parameter P is the threshold Vop in STEP9-6, i.e., if the valve head 3 has reached the position corresponding to the threshold Vop, i.e., the position of the valve head 3 that is displaced from the closed position by 98.5% of the full displacement Y, after the processing in STEP9-2 through STEP9-5 (time t9 in FIG. 3), then the energization control means 18 performs the same processing as in STEP5-7, STEP5-8 in STEP9-7, STEP9-8. Specifically, the energization control means 18 starts a timer T200 shown in the middle portion of FIG. 3, and sets the threshold Vclstart corresponding to the position of the valve head 3 that is displaced from the closed position by 20% of the full displacement Y, as the value of the threshold parameter P.

The timer T200 is a count-down timer for measuring a preset time which determines a timing to energize the valve-closing electromagnet 5, and the preset time is determined, as described later on, when the valve head 3 is closed in the preceding opening and closing cycle thereof.

If the process of the timer T200 to measure the preset time is ended (time t10 in FIG. 3), i.e., if the preset time of the timer T200 has elapsed after the valve head 3 has reached the displaced position corresponding to the threshold Vop (time t10 in FIG. 3), then the energization control means 18 performs the same processing as in STEP5-14, STEP5-15 in STEP9-10, STEP9-11. Specifically, in order to move the valve head 3 toward the closed position under electromagnetic forces of the valve-closing electromagnet 5, the energization control means 18 starts energizing the valve-closing electromagnet 5 and resets the timer T200 to the preset time, which the timer T200 has started to measure in STEP9-7.

If the output Vx of the displacement sensor 12 drops to the present threshold parameter P and the threshold parameter P is the threshold vclstart in STEP9-12, i.e., if the valve head 3 has reached the position corresponding to the threshold Vclstart, i.e., the position of the valve head 3 that is displaced from the closed position by 20% of the full displacement Y, after the processing in STEP9-6 through STEP9-11 (time t11 in FIG. 3), then the energization control means 18 performs the same processing as in STEP5-17, STEP5-18 in STEP9-13, STEP9-14. Specifically, the energization control means 18 starts a timer T21 shown in the middle portion of FIG. 3, and sets the threshold Vlft corresponding to the position of the valve head 3 that is displaced 1 mm from the closed position, as the value of the threshold parameter P.

The timer T21 is a count-up timer for measuring a time for the valve head 3 to reach the displaced position corresponding to the threshold Vcl, i.e., the position of valve head 3 which is displaced from the closed position toward the open position by 1.5% of the full displacement Y of the valve head 3, from the displaced position corresponding to the threshold Vclstart, as representing a speed at which the valve head 3 moves when it is closed.

If the output Vx of the displacement sensor 12 drops to the present threshold parameter P and the threshold parameter P is the threshold Vlft in STEP9-15, i.e., if the valve head 3 has reached the position corresponding to the threshold Vlft, i.e., the position of the valve head 3 that is displaced 1 mm from the closed position, after the processing in STEP9-13, STEP9-14 (time t12 in FIG. 3), then the energization control means 18 performs the same processing as in STEP5-10 through STEP5-12 in STEP9-16 through STEP9-18. Specifically, the energization control means 18 stops the timer T20 that has been started in STEP9-3, and adjusts and determines the timing to de-energize the valve-opening electromagnet 6 in a next opening and closing cycle of the valve head 3, depending on the time measured by the timer T20, i.e., the measured time that has elapsed from the de-energization of the valve-opening electromagnet 6 until the valve head 3 is displaced 1 mm toward the open position. The energization control means 18 sets the threshold Vcl corresponding to the position of valve head 3 which is displaced from the closed position toward the open position by 1.5% of the full displacement Y of the valve head 3, as the value of the threshold parameter P.

More specifically, the energization control means 18 adjusts the timing to de-energize the valve-opening electromagnet 6 in the next opening and closing cycle of the valve head 3 so that the timing for the valve head 3 to be displaced 1 mm from the closed position when the valve head 3 is closed in the next opening and closing cycle agrees with a target timing determined from the rotational speed Ne, the accelerator movement quantity ACC, the engine temperature Tw, etc. Specifically, if the rotational speed Ne, the accelerator movement quantity ACC, etc. are constant, then a time which precedes the target timing by the time measured by the timer T20 is established as the timing to de-energize the valve-opening electromagnet 6.

If the output Vx of the displacement sensor 12 drops to the present threshold parameter P and the threshold parameter P is the threshold Vcl in STEP9-19, i.e., if the valve head 3 has reached the position corresponding to the threshold Vcl, i.e., the position of the valve head 3 that is displaced from the closed position by 1.5% of the full displacement Y, after the processing in STEP9-16 through STEP9-18 (time t13 in FIG. 3), then the energization control means 18 performs the same processing as in STEP5-20 through STEP5-24 in STEP9-20 through STEP9-24. Specifically, the energization control means 18 stops the timer T21 that has been started in STEP9-13, and adjusts the preset time of the timer T200 which determines the timing to energize the valve-closing electromagnet 5 in the next opening and closing cycle of the valve head 3 depending on the time measured by the timer T21, which represents the speed of the valve head 3 that has moved from the position corresponding to the threshold Vclstart to the position corresponding to the threshold Vcl, thus determining the timing to energize the valve-closing electromagnet 5. The energization control means 18 changes the energizing pattern of the valve-closing electromagnet 5 from the constant-voltage control mode to the constant-current control mode, and supplies a relatively large catching current to the valve-closing electromagnet 5. The energization control means 18 starts a timer T210 shown in the middle portion of FIG. 3, and sets the threshold Vclfail corresponding to the position of the valve head 3 that is displaced from the closed position by 5% of the full displacement Y, as the value of the threshold parameter P.

For adjusting the timing to energize the valve-closing electromagnet 5, the energization control means 18 adjusts the preset time of the timer T200 in the next opening and closing cycle so that the speed of the valve head 3 represented by the time measured by the timer T21 becomes a target value for the speed which is determined from a map based on the rotational speed Ne, the accelerator movement quantity ACC, the engine temperature Tw, etc.

The timer T210 is a count-down timer for measuring a preset time determined as a time for continuously supplying the catching current to the valve-closing electromagnet 5.

If the process of the timer T210 started in STEP9-23 to measure the preset time is ended (time t14 in FIG. 3), then the energization control means 18 executes the same processing in STEP5-26, STEP5-27 in STEP9-26, STEP9-27. Specifically, the energization control means 18 changes the current supplied to the valve-closing electromagnet 5 in the constant-current control mode from the catching current to a relatively small holding current sufficient to hold the valve head 3 in the closed position, and resets the timer T210 to its preset time.

If the process of the timer BK20 started in STEP9-4 to measure the preset time is ended, i.e., if the preset time of the timer BK20 after the valve-opening electromagnet 6 has been de-energized has elapsed, in STEP9-28, then the energization control means 18 executes the same processing in STEP5-29 through STEP5-31 in STEP9-29 through STEP9-31. Specifically, the energization control means 18 decides whether the present output Vx of the displacement sensor 12 has reached the threshold Vclfail or not. If the present output Vx of the displacement sensor 12 has reached the threshold Vclfail, then the energization control means 18 resets the timer BK20 to its preset time, after which control goes to STEP9-32. If the present output Vx of the displacement sensor 12 has not reached the threshold Vclfail for some malfunction, then the energization control means 18 executes a predetermined third failure process.

The third failure process is exactly the same as the first failure process. In the third failure process, as shown in FIG. 7, the energization control means 18 alternately energizes the electromagnets 5, 6 at a period corresponding to the natural frequency of the mechanical vibration system that is made up of the valve head 3, the springs 7, 8, and the armature 4, thereby moving the valve head 3 to the closed position, for example. After the valve head 3 has been moved to the closed position, the energization control means 18 resumes the process of normally opening and closing the valve head 3.

If the output Vx of the displacement sensor 12 rises to the present threshold parameter P and the threshold parameter P is the threshold Vclfail in STEP9-32, i.e., if the valve head 3 is displaced to the position corresponding to the threshold Vclfail for some malfunction after the processing in STEP9-20 through STEP9-24, or basically while the valve head 3 is being held in the closed position, then the energization control means 18 performs a fourth failure process in STEP9-33. The fourth failure process is similar to the second failure process that is executed in STEP5-33, details of which are shown in FIG. 8. The fourth failure process is shown in detail in FIG. 11. The energization control means 18 calculates a time from the present time to the timing to de-energize the valve-closing electromagnet 5, which timing is determined in STEP5-11, as a valve-closing electromagnet de-energization time in STEP9-33-1. Then, the energization control means 18 compares the calculated valve-closing electromagnet de-energization time with a predetermined recovery-from-failure time that is determined as a time required for the valve head 3 to return to the closed position in STEP9-33-2. If the valve-closing electromagnet de-energization time is equal to or longer than the recovery-from-failure time, then the energization control means 18 energizes the valve-opening electromagnet 5 to generate electromagnetic forces to return the valve head 3 to the closed position in the recovery-from-failure time in STEP9-33-3. After the valve head 3 has returned to the closed position, the valve head 3 is normally opened and closed.

If the valve-closing electromagnet de-energization time is shorter than the recovery-from-failure time in STEP9-33-2, then the energization control means 18 de-energizes the valve-closing electromagnet 5 in STEP9-33-4, and thereafter energizes the valve-opening electromagnet 6 at a given timing in STEP9-33-5 to move the valve head 3 to the open position. More specifically, the energization control means 18 determines a timing to energize the valve-opening electromagnet 6 so that the timing for the valve head 3 to reach the position corresponding to the threshold Vop is substantially the same as a target timing, which is determined depending on the rotational speed Ne, the accelerator movement quantity ACC, the engine temperature Tw, etc.

The process of closing the valve head 3 has been described above.

In the above embodiment, the thresholds Vcl, Vop, Vclfail, Vopfail, Vlft, Vopstart, Vclstart for the output Vx of the displacement sensor 12 which correspond to given displaced positions of the valve head 3 can be established while compensating for variations and time-dependent changes of the output characteristics of the displacement sensor 12. Stated otherwise, the above thresholds which correspond to given displaced positions of the valve head 3 can be established in a manner to match the output characteristics of individual displacement sensors 12 or states of the displacement sensor 12 from instant to instant. Therefore, the process of controlling the energization of the electromagnets 5, 6 can be carried out at desired displaced positions of the valve head 3, and the opening and closing action of the valve head 3 can be controlled according to a desired pattern.

Specifically, for opening the valve head 3, the time after the valve-closing electromagnet 5 has been de-energized until the valve head 3 is actually displaced 1 mm from the closed position, i.e., the time measured by the timer T10, can accurately be measured based on whether the output Vx of the displacement sensor 12 has reached the threshold Vlft or not, irrespectively of variations of the output characteristics of the displacement sensor 12 and time-dependent changes therein. By adjusting the timing to de-energize the valve-closing electromagnet 5 for opening the valve head 3 in the next opening and closing cycle depending on the measured time, the timing to move the valve head 3 to a given position, i.e., the position displaced 1 mm from the closed position, can be controlled at a desired timing highly reliably regardless of electromagnetic forces remaining immediately after the valve-closing electromagnet 5 is de-energized and variations in the internal pressure in the combustion chamber 1.

For opening the valve head 3, the timer T11 measures a time based on whether the output Vx of the displacement sensor 12 has reached the threshold Vopstart and the threshold vop or not. Therefore, the actual speed of the valve head 3 between two displaced positions corresponding to the thresholds Vopstart, Vop can accurately be recognized based on the time measured by the timer T11. By adjusting the timing to energize the valve-opening electromagnet 6 for opening the valve head 3 in the next opening and closing cycle depending on the measured time, the speed of the valve head 3 as it is opened can be controlled at a desired speed irrespectively of variations in the internal pressure in the combustion chamber 1 and the characteristics of the springs 7, 8 or their time-dependent changes.

For opening the valve head 3, the energization control of the valve-opening electromagnet 6 is changed from the constant-voltage control mode to the constant-current control mode based on whether the output Vx of the displacement sensor 12 has reached the threshold Vop or not. Consequently, such a mode change can be performed reliably in the displaced position corresponding to the threshold Vop irrespectively of variations of the output characteristics of the displacement sensor 12 and time-dependent changes therein. As a result, the valve head 3 can reliably reach the open position, and the time to supply the catching current in the constant-current control mode can be held to a minimum required for thereby reducing the power consumption by the valve-opening electromagnet 6.

For opening the valve head 3, the first and second failure processes are carried out based on whether the output Vx of the displacement sensor 12 has reached the threshold Vopfail or not. As a result, a malfunction of the valve head 3 can reliably be recognized irrespectively of variations of the output characteristics of the displacement sensor 12 and time-dependent changes therein. Thus, the energization of the electromagnets 5, 6 upon a malfunction can appropriately be controlled only when such a malfunction occurs.

The above advantages offered when the valve head 3 is opened are also available when the valve head 3 is closed.

In the above embodiment, there are seven thresholds established for the output Vx of the displacement sensor 12. However, the types of thresholds are not limited to the above thresholds. For example, in the above embodiment, the threshold for determining the timing to end the measurement of the time by the timer T11 relative to the speed of the valve head 3 as it is opened is the same as the threshold, i.e., the threshold Vop, for determining the timing to change the energization control of the valve-opening electromagnet 6 from the constant-voltage control mode to the constant-current control mode. However, these thresholds may be different from each other.

In the above embodiment, the thresholds Vopstart, Vop, Vclstart, Vcl for determining the measurement of the time by the timer T11 or T21 relative to the speed of the valve head 3 are established using the full output difference (DOP–DCL). However, those thresholds may be predetermined fixed thresholds. Specifically, the speed of the valve head 3, which is an important factor in smoothly introducing an air-fuel mixture into and discharging exhaust gases from the cylinders of the internal combustion engine, is susceptible to variations in the internal pressure in the combustion chamber 1 and the characteristics of the springs 7, 8 or their time-dependent changes. Even if the thresholds relative to the measurement of time by the timer T11 or T21 are set to predetermined fixed values, it is possible to compensate appropriately for the effect of such variations and changes by adjusting the timing to energize the valve-opening electromagnet 6 or the valve-closing electromagnet 5 depending on the times measured by the timers T11, T21 which represent the speed of the valve head 3. Though the speed of the valve head 3 is affected by variations in the output characteristics of the displacement sensor 12 and time-dependent changes therein, it is possible to compensate for variations in the internal pressure in the combustion chamber 1 and the characteristics of the springs 7, 8.

In the above embodiment, the output interface circuit 15 energizes or de-energizes the electromagnets 5, 6 when it is supplied from an energization or de-energization command from the microcomputer 14. However, the process of energizing or de-energizing the electromagnets 5, 6 may be hardware-implemented, rather than software-implemented by the microcomputer 14. For example, as shown in FIG. 12, the output interface circuit 15 may have an energization processing circuit 15*a* which is supplied with the output from the comparator 21 in the input interface circuit 16 and a crankshaft angle signal (TDC signal) from the internal combustion engine.

Figure 12:
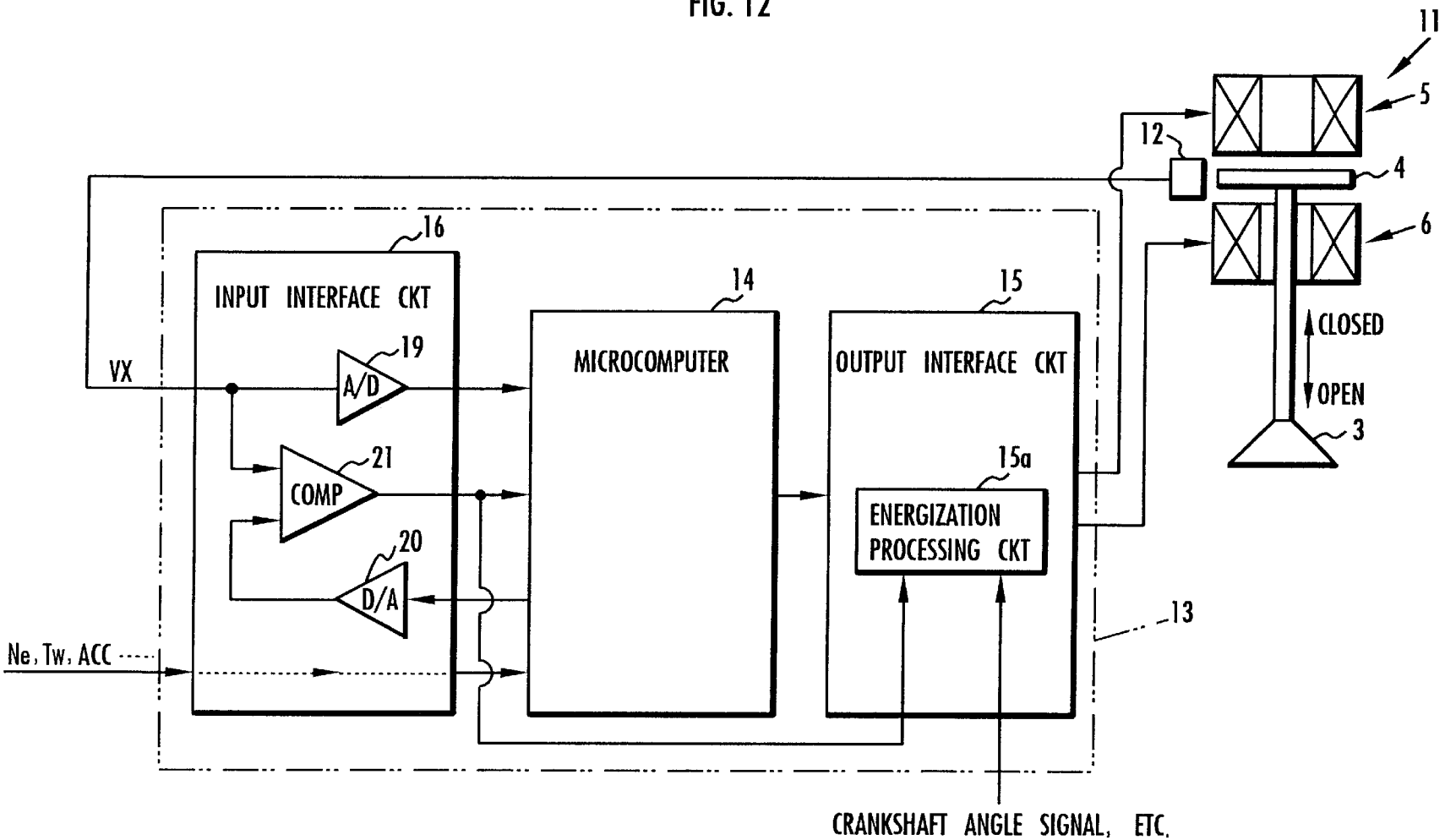
FIG. 12 is a block diagram of a system according to another embodiment of the present invention, for controlling the electromagnetic valve unit shown in FIG. 1.

According to the modified embodiment shown in FIG. 12, for opening the valve head 3, when the energization processing circuit 15*a* is supplied with a signal from the comparator 21 which indicates that the output Vx of the displacement sensor 12 has reached the threshold Vcl (time t2 in FIG. 3), the energization processing circuit 15*a* starts a timer (not shown) to measure a preset time, and then energizes the valve-opening electromagnet 6 when the measurement of the preset time by the timer is finished. Similarly, for closing the valve head 3, when the energization processing circuit 15*a* is supplied with a signal from the comparator 21 which indicates that the output Vx of the displacement sensor 12 has reached the threshold Vop (time t9 in FIG. 3), the energization processing circuit 15*a* starts a timer (not shown) to measure a preset time, and then energizes the valve-closing electromagnet 5 when the measurement of the preset time by the timer is finished. A parameter for determining the times measured by the above timers is adjusted in the same process as the above process carried out by the microcomputer 14 in the preceding opening and closing cycle of the valve head 3, and a control signal for adjusting the parameter is supplied to the energization processing circuit 15*a* in each opening and closing cycle.

The energization processing circuit 15*a* de-energizes the electromagnets 5, 6 at timings based on the crankshaft angle signal from the internal combustion engine. A parameter for determining the timings (times t8, t15 in FIG. 3) for the energization processing circuit 15*a* to de-energize the electromagnets 5, 6 is adjusted in the same process as the above process carried out by the microcomputer 14 in the preceding opening and closing cycle of the valve head 3, and a control signal for adjusting the parameter is supplied to the energization processing circuit 15*a* in each opening and closing cycle.

When the electromagnets 5, 6 are energized and de-energized by a hardware arrangement provided by the energization processing circuit 15*a*, variations in the timings to energize and de-energize the electromagnets 5, 6 are reduced.

Although certain preferred embodiments of the present invention have been shown and described in detail, it should be understood that various changes and modifications may be made therein without departing from the scope of the appended claims.

What is claimed is:

1. A method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing said valve head to a neutral position between said open position and said closed position, a valve-opening electromagnet for displacing said valve head into said open position under electromagnetic forces, a valve-closing electromagnet for displacing said valve head into said closed position under electromagnetic forces, and a displacement sensor for generating an output depending on a displaced position of said valve head, said method comprising the steps of:

determining a difference between the output of said displacement sensor when said valve head is in said open position and the output of said displacement sensor when said valve head is in said closed position in each period of an opening and closing action of said valve head, said difference corresponding to a full displacement of said valve head between said open position and said closed position, and establishing, using said difference, a threshold for the output of said displacement sensor which correspond to a predetermined displaced position of said valve head which is determined based on a proportion of said full displacement; and controlling energization of at least one of said valve-opening electromagnet and said valve-closing electromagnet depending on whether the output of said displacement sensor has reached said threshold or not upon the opening and closing action of said valve head immediately after said threshold is established.

2. A method according to claim 1, wherein said difference comprises a difference between an average value of outputs of said displacement sensor when said valve head is in said open position over a plurality of periods of the opening and closing action of said valve head and an average value of outputs of said displacement sensor when said valve head is in said closed position over a plurality of periods of the opening and closing action of said valve head.

3. A method according to claim 1, wherein said threshold includes a first threshold corresponding to a position of said valve head which is displaced from one of said open position and said closed position by a first proportion of said full displacement, and wherein said step of controlling energization of said at least one of said valve-opening electromagnet and said valve-closing electromagnet comprises the steps of:

measuring a time after said valve-closing electromagnet is de-energized until the output of said displacement sensor reaches said first threshold when said valve head is opened from said closed position; and adjusting a timing to de-energize said valve-closing electromagnet when said valve head is to be opened next time, depending on the measured time.

4. A method according to claim 1 or 3, wherein said threshold includes a second threshold corresponding to a position of said valve head which is displaced from one of said open position and said closed position by a second proportion of said full displacement, and wherein said step of controlling energization of said at least one of said valve-opening electromagnet and said valve-closing electromagnet comprises the steps of:

measuring a time after said valve-opening electromagnet is de-energized until the output of said displacement sensor reaches said second threshold when said valve head is closed from said open position; and adjusting a timing to de-energize said valve-opening electromagnet when said valve head is to be closed next time, depending on the measured time.

5. A method according to claim 1, wherein said threshold includes a third threshold corresponding to a position of said valve head which is displaced from one of said open position and said closed position by a third proportion of said full displacement, and a fourth threshold corresponding to a position of said valve head which is closer to said open position than the position corresponding to said third position and displaced from one of said open position and said closed position by a fourth proportion of said full displacement, and wherein said step of controlling energization of said at least one of said valve-opening electromagnet and said valve-closing electromagnet comprises the steps of:

measuring a time after the output of said displacement sensor reaches said third threshold until the output of said displacement sensor reaches said fourth threshold when said valve head is opened from said closed position; and adjusting a timing to energize said valve-opening electromagnet when said valve head is to be opened next time, depending on the measured time.

6. A method according to claim 1 or 5, wherein said threshold includes a fifth threshold corresponding to a position of said valve head which is displaced from one of said open position and said closed position by a fifth proprotion of said full displacement, and a sixth threshold corresponding to a position of said valve head which is closer to said closed position than the position corresponding to said fifth proportion and displaced from one of said open position and said closed position by a sixth proportion of said full displacement, and wherein said step of controlling energization of said at least one of said valve-opening electromagnet and said valve-closing electromagnet comprises the steps of:

measuring a time after the output of said displacement sensor reaches said fifth threshold until the output of said displacement sensor reaches said sixth threshold when said valve head is closed from said open position; and adjusting a timing to energize said valve-opening electromagnet when said valve head is to be closed next time, depending on the measured time.

7. A method according to claim 1, wherein said threshold includes a seventh threshold corresponding to a position of said valve head which is close to said open position and displaced from one of said open position and said closed position by a seventh proportion of said full displacement, and wherein said step of controlling energization of said at leastt one of said valve-opening electromagnet and said valve-closing electromagnet comprises the steps of:

energizing said valve-opening electromagnet in a constant-voltage control mode after said valve-opening electromagnet starts being energized until the output of said displacement sensor reaches said seventh threshold when said valve head is opened from said closed position; and energizing said valve-opening electromagnet in a constant-current control mode after the output of said displacement sensor reaches said seventh threshold.

8. A method according to claim 1 or 7, wherein said threshold includes an eighth threshold corresponding to a position of said valve head which is close to said closed position and displaced from one of said open position and said closed position by an eighth proportion of said full displacement, and wherein said step of controlling energization of said at least one of said valve-opening electromagnet and said valve-closing electromagnet comprises the steps of:

energizing said valve-closing electromagnet in a constant-voltage control mode after said valve-closing electromagnet starts being energized until the output of said displacement sensor reaches said eighth threshold when said valve head is closed from said open position; and energizing said valve-closing electromagnet in a constant-current control mode after the output of said displacement sensor reaches said eighth threshold.

9. A method according to claim 1, wherein said threshold includes a ninth threshold corresponding to a position of said valve head which is close to said open position and displaced from one of said open position and said closed position by a ninth proportion of said full displacement, and wherein said step of controlling energization of said at least one of said valve-opening electromagnet and said valve-closing electromagnet comprises the step of:

performing a first failure process to control energization of said at least one of said valve-opening electromagnet and said valve-closing electromagnet if the output of said displacement sensor has not reached said ninth threshold at a predetermined timing when said valve head is opened from said closed position.

10. A method according to claim 9, wherein said first failure process comprises a process of alternately energizing said valve-opening electromagnet and said valve-closing electromagnet in predetermined periods until said valve head reaches either one of said valve-opening electromagnet and said valve-closing electromagnet.

11. A method according to any one of claims 1, 9, or 10, wherein said threshold includes a tenth threshold corresponding to a position of said valve head which is close to said closed position and displaced from one of said open position and said closed position by a tenth proportion of said full displacement, and wherein said step of controlling energization of said at least one of said valve-opening electromagnet and said valve-closing electromagnet comprises the step of:

performing a second failure process to control energization of said at least one of said valve-opening electromagnet and said valve-closing electromagnet if the output of said displacement sensor has not reached said tenth threshold at a predetermined timing when said valve head is closed from said open position.

12. A method according to claim 11, wherein said second failure process comprises a process of alternately energizing said valve-opening electromagnet and said valve-closing electromagnet in predetermined periods until said valve head reaches either one of said valve-opening electromagnet and said valve-closing electromagnet.

13. A method according to claim 1, wherein said threshold includes an eleventh threshold corresponding to a position of said valve head which is close to said open position and displaced from one of said open position and said closed position by an eleventh proportion of said full displacement, and wherein said step of controlling energization of said at least one of said valve-opening electromagnet and said valve-closing electromagnet comprises the step of:

performing a third failure process to control energization of said at least one of said valve-opening electromagnet and said valve-closing electromagnet when the output of said displacement sensor has changed to said eleventh threshold before said valve-opening electromagnet is de-energized, after said valve head is displaced from said closed position to said open position.

14. A method according to claim 13, wherein said third failure process comprises a process of deciding whether said valve head can be returned to said open position by energizing said valve-opening electromagnet within a period up to a timing to de-energize said valve-opening electromagnet in order to close said valve head, energizing said valve-opening electromagnet to return said valve head to said open position if said valve head can be returned to said open position within said period, de-energizing said valve-opening electromagnet if said valve head cannot be returned to said open position within said period, and energizing said valve-closing electromagnet to move said valve head to said closed position at a predetermined timing.

15. A method according to any one of claims 1, 13, or 14, wherein said threshold includes a twelfth threshold corresponding to a position of said valve head which is close to said closed position and displaced from one of said open position and said closed position by a twelfth proportion of said full displacement, and wherein said step of controlling energization of said at least one of said valve-opening electromagnet and said valve-closing electromagnet comprises the step of:

performing a fourth failure process to control energization of said valve-opening electromagnet and/or said valve-closing electromagnet when the output of said displacement sensor has changed to said twelfth threshold before said valve-closing electromagnet is de-energized, after said valve head is displaced from said open position to said closed position.

16. A method according to claim 15, wherein said fourth failure process comprises a process of deciding whether said valve head can be returned to said closed position by energizing said valve-closing electromagnet within a period up to a timing to de-energize said valve-closing electromagnet in order to open said valve head, energizing said valve-closing electromagnet to return said valve head to said closed position if said valve head can be returned to said closed position within said period, de-energizing said valve-closing electromagnet if said valve head cannot be returned to said closed position within said period, and energizing said valve-opening electromagnet to move said valve head to said open position at a predetermined timing.

17. A method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing said valve head to a neutral position between said open position and said closed position, a valve-opening electromagnet for displacing said valve head into said open position under electromagnetic forces, a valve-closing electromagnet for displacing said valve head into said closed position under electromagnetic forces, and a displacement sensor for generating an output depending on a displaced position of said valve head, said method comprising the steps of:

determining a first threshold for the output of said displacement sensor which corresponds to a position of said valve head which is displaced from one of said open position and said closed position by a first distance and a second threshold for the output of said displacement sensor which is closer to said open position than the position corresponding to said first distance and displaced from one of said open position and said closed position by a second distance;

measuring a time after the output of said displacement sensor has reached said first threshold until the output of said displacement sensor reaches said second threshold when said valve head is opened from said closed position; and adjusting a timing to energize said valve-opening electromagnet when said valve head is to be opened next time, depending on the measured time.

18. A method according to claim 17, further comprising the steps of:

determining a third threshold for the output of said displacement sensor which corresponds to a position of said valve head which is displaced from one of said open position and said closed position by a third distance and a fourth threshold for the output of said displacement sensor which is closer to said closed position than the position corresponding to said third distance and displaced from one of said open position and said closed position by a fourth distance;

measuring a time after the output of said displacement sensor has reached said third threshold until the output of said displacement sensor reaches said fourth threshold when said valve head is closed from said open position; and adjusting a timing to energize said valve-closing electromagnet when said valve head is to be closed next time, depending on the measured time.

19. A method of controlling an electromagnetic valve unit in an internal combustion engine, having a valve head reciprocally movable between an open position for opening an intake or exhaust port of a combustion chamber in the internal combustion engine and a closed position for closing the intake or exhaust port, biasing means for biasing said valve head to a neutral position between said open position and said closed position, a valve-opening electromagnet for displacing said valve head into said open position under electromagnetic forces, a valve-closing electromagnet for displacing said valve head into said closed position under electromagnetic forces, and a displacement sensor for generating an output depending on a displaced position of said valve head, said method comprising the steps of:

determining a third threshold for the output of said displacement sensor which corresponds to a position of said valve head which is displaced from one of said open position and said closed position by a third distance and a fourth threshold for the output of said displacement sensor which is closer to said closed position than the position corresponding to said third distance and displaced from one of said open position and said closed position by a fourth distance;

measuring a time after the output of said displacement sensor has reached said third threshold until the output of said displacement sensor reaches said fourth threshold when said valve head is closed from said open position; and adjusting a timing to energize said valve-closing electromagnet when said valve head is to be closed next time, depending on the measured time.

* * * * *